US008001812B2

(12) United States Patent
Mahaffey et al.

(10) Patent No.: US 8,001,812 B2
(45) **Date of Patent: *Aug. 23, 2011**

(54) SECURITY APPARATUS INCLUDING LOCKING HEAD

(75) Inventors: Robert Mahaffey, Vancouver (CA); John Hung, Vancouver (CA); John Tan, Vancouver (CA); Will Ali, Vancouver (CA); Ryan White, Salem, MA (US); Michael Xiao Lei Liang, Vancouver (CA)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/977,486

(22) Filed: Dec. 23, 2010

(65) Prior Publication Data

US 2011/0080707 A1 Apr. 7, 2011

Related U.S. Application Data

(63) Continuation of application No. 12/891,707, filed on Sep. 27, 2010, which is a continuation-in-part of application No. PCT/US2010/036628, filed on May 28, 2010.

(60) Provisional application No. 61/182,591, filed on May 29, 2009.

(51) Int. Cl.
*E05B 73/00* (2006.01)

(52) U.S. Cl. ..... 70/58; 70/14; 70/34; 70/232; 70/379 R

(58) Field of Classification Search ..... 70/77, 78, 70/85, 38 R, 39, 38 B, 38 C, 41–43, 45, 46, 70/DIG. 9, 34, 232, 379 R, 379 A, 380, 14, 18, 53, 57, 58; 248/551–553; 361/679.57, 679.58

See application file for complete search history.

(56) References Cited

U.S. PATENT DOCUMENTS

| | | | | |
|---|---|---|---|---|
| 14,059 | A * | 1/1856 | Harrison | 70/38 B |
| 87,045 | A | 2/1869 | Holmes | |
| 95,509 | A | 10/1869 | Petre | |
| 285,074 | A | 9/1883 | Rhoades et al. | |
| 505,299 | A | 9/1893 | Schneider | |

(Continued)

FOREIGN PATENT DOCUMENTS

CA 454901 3/1949

(Continued)

OTHER PUBLICATIONS

Kablit Security System Catalog, pp. 7, 93, 1988. Computer and Office Equipment Security Catalog, 1990, Secure-It, Inc., 18 Maple Court, East Longmeadow, MA 01028.

(Continued)

*Primary Examiner* — Lloyd Gall

(74) *Attorney, Agent, or Firm* — Kilpatrick Townsend & Stockton LLP

(57) ABSTRACT

A security apparatus is disclosed. The security apparatus comprises an attachment device comprising a base, and a locking head configured to secure to the base. The attachment device can be small and strong. The locking head can have a securing element and a locking component, associated with a housing. The locking head may be in a secured configuration upon a single motion or movement of the locking head. The locking head may contain one or more gate structures for securing to the attachment device.

19 Claims, 18 Drawing Sheets

U.S. PATENT DOCUMENTS

| | | | | | |
|---|---|---|---|---|---|
| 541,630 | A | | 6/1895 | Ridgway | |
| 606,734 | A | | 7/1898 | Olmstead | |
| 611,646 | A | | 10/1898 | Parker | |
| 786,842 | A | | 4/1905 | Robeson | |
| 881,364 | A | | 3/1908 | Wheeler | |
| 934,928 | A | | 9/1909 | Michel | |
| 942,537 | A | | 12/1909 | Batdorf | |
| 952,411 | A | | 3/1910 | Billy | |
| 989,484 | A | | 4/1911 | Campbell | |
| 1,004,333 | A | | 9/1911 | Alsterberg | |
| 1,050,276 | A | | 1/1913 | Johnson | |
| 1,101,450 | A | | 6/1914 | Kerry | |
| 1,213,992 | A | | 1/1917 | Wright | |
| 1,270,205 | A | * | 6/1918 | Pongracz | 70/38 B |
| 1,387,442 | A | | 8/1921 | Lee | |
| 1,432,546 | A | | 10/1922 | Gillom | |
| 1,452,471 | A | | 4/1923 | Kline | |
| 1,468,955 | A | | 9/1923 | Bresee | |
| 1,468,958 | A | | 9/1923 | Champion | |
| 1,470,937 | A | | 10/1923 | Schou | |
| 1,534,936 | A | | 4/1925 | Fishchbach | |
| 1,672,333 | A | | 6/1928 | Miller | |
| 1,728,902 | A | * | 9/1929 | Cohen | 70/26 |
| 1,786,511 | A | | 12/1930 | Warren | |
| 1,851,986 | A | | 4/1932 | Rubsamen | |
| 1,891,214 | A | | 12/1932 | Falk | |
| 1,978,935 | A | | 1/1933 | Douglas | |
| 1,929,679 | A | * | 10/1933 | Duncan | 70/232 |
| 1,998,050 | A | * | 4/1935 | Gasdorf | 138/89.1 |
| 2,001,354 | A | | 5/1935 | Smith | |
| 2,032,821 | A | | 3/1936 | Waits | |
| 2,102,583 | A | | 12/1937 | Alberg | |
| 2,109,109 | A | | 2/1938 | Finch | |
| 2,130,216 | A | | 9/1938 | Zaninovich | |
| 2,172,208 | A | | 9/1939 | Kutrzon | |
| 2,190,661 | A | | 2/1940 | Hauer | |
| 2,383,397 | A | | 8/1945 | Lofquist | |
| 2,405,400 | A | | 8/1946 | Butterfiled | |
| 2,407,406 | A | * | 9/1946 | Dutton | 70/38 B |
| 2,435,876 | A | | 2/1948 | De Swart | |
| 2,469,874 | A | | 5/1949 | Fetsko, Jr. | |
| 2,480,662 | A | | 8/1949 | McKinzie | |
| 2,530,560 | A | | 11/1950 | Young | |
| 2,577,956 | A | | 12/1951 | Elsberg | |
| 2,578,547 | A | | 12/1951 | Hilger | |
| 2,594,012 | A | | 4/1952 | Griffin | |
| 2,660,084 | A | | 11/1953 | Newman | |
| 2,677,261 | A | | 5/1954 | Jacobi | |
| 2,729,418 | A | | 1/1956 | Maynard | |
| 2,800,090 | A | | 7/1957 | Reid | |
| 2,963,310 | A | | 12/1960 | Abolins | |
| 3,091,011 | A | | 5/1963 | Campbell | |
| 3,101,695 | A | | 8/1963 | Honeyman, Jr. | |
| 3,130,571 | A | | 4/1964 | Neumann | |
| 3,136,017 | A | | 6/1964 | Preziosi | |
| 3,171,182 | A | | 3/1965 | Danehy | |
| 3,174,384 | A | | 3/1965 | Vanni | |
| 3,200,694 | A | | 8/1965 | Rapata | |
| 3,211,408 | A | | 10/1965 | Schaefer | |
| 3,213,745 | A | | 10/1965 | Dwyer | |
| 3,220,077 | A | | 11/1965 | Newcomer, Jr. et al. | |
| 3,267,707 | A | | 8/1966 | Adams | |
| 3,276,835 | A | | 10/1966 | Hall | |
| 3,380,268 | A | | 4/1968 | Perrill | |
| 3,469,874 | A | | 9/1969 | Mercurio | |
| 3,486,158 | A | | 12/1969 | Soltysik et al. | |
| 3,509,748 | A | | 5/1970 | George | |
| 3,521,845 | A | | 7/1970 | Sweda et al. | |
| 3,524,335 | A | | 8/1970 | George | |
| 3,541,819 | A | | 11/1970 | Keer | |
| 3,590,608 | A | | 7/1971 | Smyth et al. | |
| 3,596,285 | A | | 7/1971 | Garland | |
| 3,625,031 | A | | 12/1971 | Alley, III | |
| 3,634,963 | A | | 1/1972 | Hermann | |
| 3,664,163 | A | | 5/1972 | Foote | |
| 3,722,239 | A | | 3/1973 | Mestre | |
| 3,727,934 | A | | 4/1973 | Averbook et al. | |
| 3,737,135 | A | | 6/1973 | Bertolini | |
| 3,738,136 | A | | 6/1973 | Falk | |
| 3,754,420 | A | | 8/1973 | Oellerich | |
| 3,765,197 | A | | 10/1973 | Foote | |
| 3,766,760 | A | | 10/1973 | Mohrhauser et al. | |
| 3,771,338 | A | | 11/1973 | Raskin | |
| 3,772,645 | A | | 11/1973 | Odenz et al. | |
| 3,782,146 | A | | 1/1974 | Franke | |
| 3,783,660 | A | | 1/1974 | Gill | |
| 3,785,183 | A | | 1/1974 | Sander | |
| 3,798,934 | A | | 3/1974 | Wright et al. | |
| 3,813,906 | A | | 6/1974 | Kerr | |
| 3,817,066 | A | | 6/1974 | Pearson | |
| 3,826,510 | A | | 7/1974 | Halter | |
| D232,416 | S | | 8/1974 | Gazda et al. | |
| 3,836,704 | A | | 9/1974 | Coules | |
| 3,859,826 | A | | 1/1975 | Singer et al. | |
| 3,866,873 | A | | 2/1975 | Bohli | |
| 3,875,645 | A | | 4/1975 | Tucker et al. | |
| 3,878,700 | A | | 4/1975 | Lopez | |
| 3,898,641 | A | | 8/1975 | Banner | |
| 3,903,720 | A | | 9/1975 | Scherbing | |
| 3,905,570 | A | | 9/1975 | Nieuwveld | |
| 3,910,079 | A | | 10/1975 | Gassaway | |
| 3,910,081 | A | | 10/1975 | Pender | |
| 3,939,752 | A | | 2/1976 | Koscik | |
| 3,986,780 | A | | 10/1976 | Nivet | |
| 3,990,276 | A | | 11/1976 | Shontz | |
| 3,999,410 | A | | 12/1976 | Hall | |
| 4,003,228 | A | | 1/1977 | Lievens et al. | |
| 4,004,440 | A | | 1/1977 | Dreyer | |
| 4,006,615 | A | | 2/1977 | Szova | |
| 4,007,613 | A | | 2/1977 | Gassaway | |
| 4,018,339 | A | | 4/1977 | Pritz | |
| 4,028,913 | A | | 6/1977 | Falk | |
| 4,028,916 | A | | 6/1977 | Pender | |
| 4,041,739 | A | | 8/1977 | Mercurio | |
| 4,047,748 | A | | 9/1977 | Whaley et al. | |
| 4,055,973 | A | | 11/1977 | Best | |
| 4,057,984 | A | | 11/1977 | Avaiusini | |
| 4,065,083 | A | | 12/1977 | Gassaway | |
| 4,066,195 | A | | 1/1978 | Dickler | |
| 4,066,231 | A | | 1/1978 | Bahner | |
| 4,069,696 | A | | 1/1978 | Steinbach | |
| 4,078,405 | A | | 3/1978 | Steinbach | |
| 4,104,951 | A | | 8/1978 | Leitner | |
| 4,111,020 | A | | 9/1978 | Scherbing | |
| 4,112,820 | A | | 9/1978 | Conger et al. | |
| 4,114,409 | A | | 9/1978 | Scire | |
| 4,118,902 | A | | 10/1978 | Saxton | |
| 4,123,922 | A | | 11/1978 | Kuenstler | |
| 4,131,001 | A | | 12/1978 | Gotto | |
| 4,212,175 | A | | 7/1980 | Zakow | |
| 4,223,542 | A | | 9/1980 | Basseches | |
| 4,252,007 | A | | 2/1981 | Kerley | |
| 4,263,833 | A | | 4/1981 | Loudin | |
| 4,290,279 | A | * | 9/1981 | Fish et al. | 70/38 A |
| 4,300,371 | A | | 11/1981 | Herwick et al. | |
| 4,311,883 | A | | 1/1982 | Kidney | |
| 4,328,691 | A | | 5/1982 | Scherbing | |
| 4,337,462 | A | | 6/1982 | Lemelson | |
| 4,383,425 | A | | 5/1983 | Orabona | |
| 4,391,110 | A | | 7/1983 | Nielsen | |
| 4,394,101 | A | | 7/1983 | Richer | |
| 4,418,550 | A | | 12/1983 | Hamilton | |
| 4,419,034 | A | | 12/1983 | DiMartino | |
| 4,442,571 | A | | 4/1984 | Davis et al. | |
| 4,448,049 | A | | 5/1984 | Murray | |
| 4,462,233 | A | | 7/1984 | Horetzke | |
| 4,466,259 | A | | 8/1984 | Osgood | |
| 4,471,980 | A | | 9/1984 | Hickman | |
| 4,478,545 | A | | 10/1984 | Mizusawa | |
| 4,501,460 | A | | 2/1985 | Sisler | |
| 4,502,305 | A | | 3/1985 | Bakker | |
| 4,507,945 | A | | 4/1985 | Hwang | |
| 4,520,641 | A | | 6/1985 | Bako | |
| 4,527,405 | A | | 7/1985 | Renick et al. | |
| 4,546,629 | A | | 10/1985 | Hwang | |
| 4,570,465 | A | | 2/1986 | Bennett | |
| 4,579,492 | A | | 4/1986 | Kazino | |

4,584,856 A 4/1986 Petersdorff et al.
4,586,843 A 5/1986 Henge et al.
4,593,273 A 6/1986 Narcisse
4,598,272 A 7/1986 Cox
4,603,829 A 8/1986 Koike et al.
4,610,152 A 9/1986 Duringer
4,610,587 A 9/1986 Wollar
4,616,490 A 10/1986 Robbins
4,620,182 A 10/1986 Keifer
4,640,106 A 2/1987 Derman
4,651,544 A 3/1987 Hungerford
4,653,297 A 3/1987 Moorhouse
4,654,640 A 3/1987 Carll et al.
4,655,057 A 4/1987 Derman
4,656,848 A 4/1987 Rose
4,667,491 A 5/1987 Lokken et al.
4,676,080 A 6/1987 Schwarz
4,680,949 A 7/1987 Stewart
4,685,312 A 8/1987 Lakoski et al.
4,691,891 A 9/1987 Dionne
4,692,968 A 9/1987 Girard
4,704,881 A 11/1987 Sloop, Sr.
4,722,208 A 2/1988 Ye
4,733,840 A 3/1988 D'Amore
4,735,067 A 4/1988 Tawil
4,738,428 A 4/1988 Themistos et al.
4,741,185 A 5/1988 Weinert et al.
4,768,361 A 9/1988 Derman
4,770,583 A 9/1988 Lindberg
4,779,434 A 10/1988 Derman
4,785,291 A 11/1988 Hawthorne
4,801,232 A 1/1989 Hempel
4,802,354 A 2/1989 Johnson
4,803,860 A 2/1989 Moore
4,804,943 A 2/1989 Soleimani
4,805,426 A 2/1989 Dimmick et al.
4,813,252 A 3/1989 Ray
4,818,032 A 4/1989 Thomas
4,826,193 A 5/1989 Davis
4,831,852 A 5/1989 Hughes
4,831,860 A 5/1989 Sheiman et al.
4,834,600 A 5/1989 Lemke
4,842,912 A 6/1989 Hutter, III
4,843,848 A 7/1989 Igelmund
4,856,304 A 8/1989 Derman
4,856,305 A 8/1989 Adams
4,858,455 A 8/1989 Kuo
4,860,561 A 8/1989 Hwang
4,862,716 A 9/1989 Derman
4,869,082 A 9/1989 Appelbaum
4,870,840 A 10/1989 Klein
4,878,045 A 10/1989 Tanaka et al.
4,893,488 A 1/1990 Klein
4,896,140 A 1/1990 Biever
4,901,057 A 2/1990 Suneborn
4,907,111 A 3/1990 Derman
4,907,716 A 3/1990 Wankel et al.
4,908,605 A 3/1990 Takatsuka
4,912,953 A 4/1990 Wobig
4,918,952 A 4/1990 Lakoski et al.
4,924,683 A 5/1990 Derman
4,924,693 A 5/1990 College
4,938,040 A 7/1990 Humphreys, Jr.
4,959,635 A 9/1990 Wilson
4,959,979 A 10/1990 Filipow et al.
4,964,285 A 10/1990 Lakoski
4,966,511 A 10/1990 Lee
4,969,342 A * 11/1990 Marchiori ..... 70/49
4,978,265 A 12/1990 DeWan
4,979,382 A 12/1990 Perry
4,985,695 A 1/1991 Wilkinson et al.
4,986,097 A 1/1991 Derman
4,993,244 A 2/1991 Osman
5,001,460 A 3/1991 Basson
5,001,854 A 3/1991 Derman
5,010,748 A 4/1991 Derman
5,020,349 A 6/1991 Lee
5,022,242 A 6/1991 Povilaitis
5,024,072 A 6/1991 Lee
5,027,627 A 7/1991 Derman
5,050,836 A 9/1991 Makous
5,052,199 A 10/1991 Derman
5,063,763 A 11/1991 Johnson
5,066,942 A 11/1991 Matsuo
5,067,151 A 11/1991 Inagaki
5,076,079 A 12/1991 Monoson
5,082,232 A 1/1992 Wilson
5,082,233 A 1/1992 Ayers et al.
5,099,663 A 3/1992 Dearstine
5,117,661 A 6/1992 Carl et al.
5,119,649 A 6/1992 Spence
5,133,203 A 7/1992 Huang
5,135,197 A 8/1992 Kelley et al.
5,138,785 A 8/1992 Paterson
5,146,769 A 9/1992 Smith
5,154,456 A 10/1992 Moore
5,169,326 A 12/1992 Werner
5,171,049 A 12/1992 Grandy, Sr. et al.
5,184,798 A 2/1993 Wilson
5,197,706 A 3/1993 Braithwaite et al.
5,223,815 A 6/1993 Rosenthal et al.
D337,040 S 7/1993 Carl
5,228,319 A 7/1993 Holley et al.
5,235,831 A 8/1993 Lauria et al.
5,279,136 A 1/1994 Perry
D346,733 S 5/1994 Carl et al.
5,317,304 A 5/1994 Choi
5,327,752 A 7/1994 Myers et al.
D350,473 S 9/1994 Simon
5,349,834 A 9/1994 Davidge
5,349,835 A 9/1994 Liao
5,351,507 A 10/1994 Derman
5,351,508 A 10/1994 Kelley
5,361,610 A 11/1994 Sanders
5,370,488 A 12/1994 Sykes
5,377,512 A 1/1995 Kelley
5,381,685 A 1/1995 Carl et al.
5,386,005 A 1/1995 Mascia et al.
5,390,514 A 2/1995 Harmon
5,390,977 A 2/1995 Miller
5,394,713 A 3/1995 Harmon
5,397,176 A 3/1995 Allen et al.
5,398,530 A 3/1995 Derman
5,400,622 A 3/1995 Harmon
5,402,662 A 4/1995 Osada
5,406,809 A 4/1995 Igelmund
5,412,959 A 5/1995 Bentley
5,421,667 A 6/1995 Leyden et al.
5,447,044 A 9/1995 Cheng
5,447,045 A * 9/1995 Cheng ..... 70/58
5,447,049 A 9/1995 Shien
5,466,022 A 11/1995 Derman
5,473,917 A 12/1995 Say
5,489,173 A 2/1996 Hofle
5,493,878 A 2/1996 Murray et al.
5,502,989 A 4/1996 Murray et al.
5,520,031 A 5/1996 Davidge
D370,473 S 6/1996 Derman
D370,621 S 6/1996 Themistos et al.
5,544,512 A 8/1996 Shieh
5,548,981 A 8/1996 Kirk
5,570,080 A 10/1996 Inoue et al.
5,579,657 A 12/1996 Makous
5,593,878 A 1/1997 Knopf et al.
5,603,416 A 2/1997 Richardson et al.
5,608,605 A 3/1997 Siow et al.
5,610,587 A 3/1997 Fujiuchi et al.
5,611,223 A 3/1997 Spitzer
5,622,064 A 4/1997 Gluskoter et al.
5,622,067 A 4/1997 Waitz
5,636,539 A 6/1997 Tsai
5,653,136 A 8/1997 Huang
5,661,991 A 9/1997 Hsu
5,687,592 A 11/1997 Penniman
5,692,400 A 12/1997 Bliven et al.
5,709,110 A 1/1998 Greenfield et al.
5,722,268 A 3/1998 Choi
5,761,934 A 6/1998 Kuo 5,787,738 A 8/1998 Brandt et al.
5,787,739 A 8/1998 Derman
5,791,171 A 8/1998 Kelley
5,794,463 A 8/1998 McDaid
5,799,520 A 9/1998 Laabs et al.
5,836,183 A 11/1998 Derman
5,870,281 A 2/1999 Kim
5,875,657 A 3/1999 Kelley
5,884,508 A 3/1999 Dwight
5,889,463 A 3/1999 Judd et al.
5,913,907 A 6/1999 Lee
5,924,313 A 7/1999 Kuo
5,934,120 A 8/1999 Kuo
5,960,651 A 10/1999 Tanisawa
5,963,131 A 10/1999 D'Angelo et al.
5,983,679 A 11/1999 Reyes
5,987,937 A 11/1999 Lee
5,987,940 A * 11/1999 Chang ..... 70/38 A
6,000,251 A 12/1999 Murray et al.
6,000,252 A 12/1999 Murray et al.
6,006,557 A 12/1999 Carl et al.
6,038,891 A 3/2000 Zeren et al.
6,058,744 A 5/2000 Ling
6,081,974 A 7/2000 McDaid
6,087,939 A 7/2000 Leyden et al.
6,112,561 A 9/2000 Carl
6,112,562 A 9/2000 Murray, Jr. et al.
6,125,669 A 10/2000 McDaid et al.
6,133,830 A 10/2000 D'Angelo et al.
6,150,940 A 11/2000 Chappman et al.
6,155,088 A 12/2000 Murray, Jr. et al.
6,170,364 B1 1/2001 Johnson
6,173,591 B1 1/2001 Derman
6,199,413 B1 3/2001 McDaid et al.
6,205,824 B1 3/2001 Miao
6,212,918 B1 4/2001 Kravtin
6,212,922 B1 4/2001 Miao
6,227,017 B1 5/2001 Inglemund
6,244,080 B1 6/2001 Sakurai
6,244,082 B1 6/2001 Avganim
6,255,957 B1 7/2001 Sonderegger et al.
6,257,029 B1 7/2001 Liao
6,262,664 B1 7/2001 Maloney
6,265,974 B1 7/2001 D'Angelo et al.
6,300,874 B1 10/2001 Rand
6,301,940 B1 10/2001 Derman et al.
6,317,936 B1 11/2001 McDaid et al.
6,360,405 B1 3/2002 McDaid et al.
6,389,853 B1 5/2002 Pate et al.
6,389,854 B1 5/2002 Huang
6,401,502 B1 6/2002 Yang
6,401,504 B1 6/2002 Derman et al.
6,420,958 B1 7/2002 Miller et al.
6,427,499 B1 8/2002 Derman
6,442,984 B1 9/2002 Katoh et al.
6,449,992 B1 9/2002 Yu
6,463,770 B1 10/2002 Lee
6,513,350 B1 2/2003 Hurd et al.
6,523,373 B1 2/2003 Su
6,523,378 B2 2/2003 Kuo
6,553,794 B1 4/2003 Murray, Jr. et al.
6,584,819 B1 7/2003 Hung
6,588,241 B1 7/2003 Murray, Jr. et al.
6,591,642 B1 7/2003 Kuo
6,598,433 B1 7/2003 Malvasio
6,619,080 B1 9/2003 Yu
6,619,081 B1 9/2003 Yu
6,621,415 B1 9/2003 Willis
6,672,117 B2 1/2004 Yu
6,705,133 B1 3/2004 Auganim
6,718,808 B2 4/2004 Yu
6,735,990 B1 5/2004 Murray, Jr. et al.
6,745,330 B1 6/2004 Maillot
6,758,069 B2 7/2004 Derman
6,763,688 B1 7/2004 Syu
6,763,690 B2 7/2004 Galant
6,799,445 B1 10/2004 Tsai
6,811,415 B2 11/2004 Chen
6,845,643 B2 1/2005 Tsai
6,848,926 B2 2/2005 Ling et al.
6,886,376 B2 5/2005 Kuo
6,911,897 B2 6/2005 Miller et al.
6,918,272 B1 7/2005 Sanders
6,933,847 B2 8/2005 Feibelman
6,971,254 B2 12/2005 Bellow, Jr. et al.
6,973,809 B2 12/2005 Chang
6,991,479 B2 1/2006 Miao
D515,399 S 2/2006 Ho
7,007,522 B1 3/2006 Lee
7,028,513 B2 4/2006 Avganim
7,076,977 B2 7/2006 Lee
7,079,032 B2 7/2006 Merrem et al.
7,111,479 B2 9/2006 Murray et al.
7,121,125 B2 10/2006 Murray et al.
7,140,210 B2 11/2006 Cheng
7,143,614 B1 12/2006 Murray et al.
7,150,168 B1 12/2006 Kuo
7,160,137 B1 1/2007 Yeh
7,191,623 B2 3/2007 Francke
7,234,330 B2 6/2007 Tseng
7,370,499 B1 5/2008 Lee
7,409,842 B2 8/2008 Kuo
7,415,852 B1 8/2008 Merrem
7,428,834 B1 9/2008 Lee
7,441,426 B2 10/2008 Avganim
7,441,431 B2 10/2008 Weber et al.
7,462,045 B1 12/2008 Lee
7,479,879 B2 1/2009 Merrem et al.
7,500,371 B2 3/2009 Andres et al.
7,540,334 B2 6/2009 Gass et al.
7,562,545 B2 * 7/2009 Lai et al. ..... 70/21
7,614,264 B2 11/2009 McGettrick
7,614,266 B2 11/2009 White et al.
7,635,272 B2 12/2009 Poppe
7,642,671 B2 1/2010 Mahaffey
7,647,796 B2 1/2010 Francke
7,685,854 B2 3/2010 Xu et al.
7,730,751 B2 6/2010 Andres et al.
7,805,969 B2 10/2010 Poppe et al.
2001/0049949 A1 * 12/2001 Igelmund ..... 70/58
2002/0104337 A1 8/2002 Kuo
2002/0134119 A1 9/2002 Derman
2003/0101778 A1 6/2003 Carl et al.
2003/0224637 A1 12/2003 Ling
2004/0040350 A1 3/2004 Derman
2004/0074264 A1 4/2004 Kung et al.
2004/0079122 A1 4/2004 Tsai
2004/0206138 A1 10/2004 Murray et al.
2005/0039502 A1 2/2005 Avganim
2005/0097930 A1 5/2005 Moore et al.
2005/0150262 A1 7/2005 Murray et al.
2005/0150263 A1 7/2005 Murray et al.
2005/0178173 A1 8/2005 Kuo
2005/0202698 A1 9/2005 Miao
2005/0204786 A1 9/2005 Meyer et al.
2005/0236521 A1 10/2005 Krause et al.
2005/0280500 A1 12/2005 Miller et al.
2006/0081021 A1 4/2006 Merrem et al.
2006/0107073 A1 5/2006 Lane et al.
2006/0112740 A1 6/2006 Merrem et al.
2006/0117816 A1 6/2006 Lee
2007/0033975 A1 2/2007 Liu
2008/0110217 A1 5/2008 Andrews et al.
2009/0049876 A1 2/2009 White
2009/0090149 A1 4/2009 Fox
2010/0024497 A1 2/2010 Wu
2010/0139337 A1 6/2010 Hung
2010/0192642 A1 8/2010 Hung
2010/0263414 A1 10/2010 Andres et al.

FOREIGN PATENT DOCUMENTS

CA 791364 8/1968
CA 987121 4/1976
DE 329934 12/1920
DE 335741 4/1921
DE 361068 4/1923
DE 456219 2/1928
DE 577757 8/1932

| | | | |
|---|---|---|---|
| DE | 3202700 | A1 | 4/1983 |
| DE | 3407723 | A1 | 5/1985 |
| DE | 3824393 | | 7/1989 |
| DE | 10203847 | | 8/2003 |
| DE | 202004015891 | C1 | 12/2004 |
| FR | 455740 | | 8/1913 |
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| FR | 2741375 | | 5/1997 |
| GB | 447091 | | 5/1936 |
| GB | 1256295 | | 12/1971 |
| GB | 1376011 | | 12/1974 |
| GB | 2109109 | A | 5/1983 |
| GB | 2201725 | | 9/1988 |
| GB | 2234856 | A | 2/1991 |
| HU | P0000398 | | 6/2000 |
| HU | 224329 | | 6/2003 |
| IT | 451949 | | 10/1949 |
| JP | 49-91096 | | 11/1947 |
| JP | 37-7592 | | 6/1959 |
| JP | 52-36813 | | 3/1977 |
| JP | 57-25092 | | 2/1982 |
| JP | 57-179618 | | 11/1982 |
| JP | 087462 | | 1/1996 |
| JP | 2000-305845 | | 11/2000 |
| JP | 2003-314100 | A | 11/2003 |
| JP | 2000-140948 | | 5/2005 |
| NO | 14095 | | 5/1905 |
| WO | WO 95/10680 | | 4/1985 |
| WO | WO 86/00396 | | 1/1986 |
| WO | WO 93/15295 | | 8/1993 |
| WO | WO 96/07002 | A1 | 3/1996 |
| WO | WO 96/15347 | A1 | 5/1996 |
| WO | WO 2008/051919 | A1 | 5/2008 |
| WO | WO 2008/051930 | A1 | 5/2008 |
| WO | WO 2008/147818 | A1 | 12/2008 |
| WO | WO 2009/026225 | A1 | 2/2009 |
| WO | WO 2010/080402 | A1 | 7/2010 |

OTHER PUBLICATIONS

Kensington Product Brochure for Kensington Apple Laser Writer and MacIntosh Portable Security Systems, Computer and Office Equipment Security Catalog, 1990, Secure-It, Inc., 18 Maple Court, East Longmeadow, MA 01028.
Apple Security Bracket sold in AS kit.
Retaining Device Incorporated in Apple Computers.
Kensington MicroSaver Computer Lock Box and Literature, 3 pages.
Kensington Product News Release; "Kensington Wins Case Protecting Cable Lock Status", 2003, 1 page.
*ACCO Brands, Inc.* v. *Micro Security Devices, Inc.* Federal Circuit Court Order Granting Defendant's Motion for Summary Judgment, Jul. 23, 2002, 13 pages.
Maltoni. D. et al.; "Handbook of Fingerprint Recognition"; Chapter 1: Introduction, 2003, Springer, New York, pp. 1-52.
Passproof User Manual 1990, 5 pages.
Flexguard Security System, Philadelphia Security Products (no date on page) (1 page).
Los Angeles Times, Jan. 12, 1989, Part V, p. 10.
Kensington Microsaver Packaging and Manual (copyright 1992), 4 pages.
Targus DEFCON 1 Ultra Notebook Computer Security System, User's Guide, copyright 2001.
Targus DEFCON 1 Ultra Notebook Computer Security System; http://www.targus.com/us/product_details.asp?sku=PA400U.
U.S. Appl. No. 12/242,059, filed Sep. 30, 2008.
U.S. Appl. No. 12/446,560, filed Apr. 21, 2009.
U.S. Appl. No. 12/446,556, filed Apr. 21, 2009.
U.S. Appl. No. 12/870,599, filed Aug. 27, 2010.
Vantec Notebook Lock, model # NBL-S100, 2004, 1 page.
U.S. Appl. No. 12/969,401, filed Dec. 15, 2010.
The International Search Report for Application No. PCT/US2010/036628, mailed Jan. 14, 2011, 7 pages.
The International Written Opinion for Application No. PCT/US2010/036628, mailed Jan. 14, 2011, 7 pages.
U.S. Appl. No. 12/891,707, filed Sep. 27, 2010, 37 pages.
U.S. Appl. No. 12/987,000, filed Jan. 7, 2011, 35 pages.
U.S. Appl. No. 61/182,591, filed May 29, 2009, 14 pages.
Kryptonite Combo Lock Review, dated Apr. 20, 2011, 10 pages.
Notebook Computer Combination Lock, APC Kryptonite, 2002, 2 pages.
Non-Final Office Action for U.S. Appl. No. 12/969,401, mailed Apr. 13, 2011, 31 pages.
DS-SNAP-IT-MXS, Datamation, 2007, 1 page.

* cited by examiner

SECURITY APPARATUS INCLUDING LOCKING HEAD

CROSS-REFERENCES TO RELATED APPLICATIONS

The present application is a continuation of U.S. patent application Ser. No. 12/891,707, entitled "SECURITY APPARATUS INCLUDING ATTACHMENT DEVICE," filed Sep. 27, 2010, which is a continuation-in-part of International Application No. PCT/US2010/036628, filed May 28, 2010, which claims benefit under 35 U.S.C. §119(e) of U.S. Provisional Patent Application No. 61/182,591, entitled "SECURITY APPARATUS INCLUDING ATTACHMENT DEVICE," filed May 29, 2009, the entire disclosures of which are incorporated herein by reference for all purposes. The present application is related to co-pending U.S. patent application Ser. No. 12/969,401, entitled "SECURITY APPARATUS INCLUDING LOCKING HEAD AND ATTACHMENT DEVICE," filed on Dec. 15, 2010.

BACKGROUND

Embodiments of the present invention relate to devices for inhibiting the theft of relatively small but expensive pieces of equipment.

Computers have evolved rather rapidly from large, expensive machines usable only by a few, to relatively small, portable machines which are usable by many. In particular, the development of smaller desktop or laptop (e.g., notebook or tablet) computers with significant processing power has made computers available to the general population. It is now common for college and even high school students to have their own computer, and laptop computers are in wide spread use as word processors and work stations in almost all forms of business. Laptop computers are relatively small and easily transportable, and an undesirable side effect of their proliferation is the fact that the theft of such computers is a significant problem.

A variety of devices have been developed to inhibit the theft of computers, such as laptop or desktop computers and similar equipment. Since desktop computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment.

One way to address the problem of computer security is to provide a small, generally rectangular slot in a wall of a computer. A security apparatus with a locking head may be secured to the computer via the rectangular slot.

While this solution can be effective, improvements could be made. For example, the security apparatus can take a number of steps to attach to the slot. A user needs to align the security apparatus locking head with the slot, and then needs to turn a key to rotate a T-bar to a locked configuration. This takes a number of steps and requires a fair amount of effort on the part of the user. It would be desirable to secure a computer to an immovable object with a security apparatus in fewer steps. Further, some computer manufacturers may want to use a different solution that can adapt to more slots other than a typical rectangular slot, or that can adapt to other types of computer configurations.

Embodiments of the invention address these and other problems, individually and collectively.

BRIEF SUMMARY

Embodiments of the invention relate to security apparatuses, as well as methods for making and using security apparatuses.

One embodiment of the invention is directed to a security apparatus comprising an attachment device comprising a cap and a head. The attachment device has an axial pull strength of greater than about 125 lbs. The head comprises (i) a housing, (ii) a gate structure within the housing and configured to engage the cap, (iii) a biasing element configured to bias the gate structure toward the cap, and (iv) a locking component inside of the housing.

Another embodiment of the invention is directed to a system comprising a hand-carried article, an immovable object, article and a security apparatus. The security apparatus comprises an attachment device comprising a cap and a head. The attachment device has an axial pull strength of greater than about 125 lbs. The head comprises (i) a housing, (ii) a gate structure within the housing and configured to engage the cap, (iii) a biasing element configured to bias the gate structure toward the cap, and (iv) a locking component inside of the housing.

Another embodiment of the invention is directed to a method comprising: obtaining a portable article, and an attachment device attached to the portable article; and attaching a head to the attachment device. The attachment device has an axial pull strength of greater than about 125 lbs. The head comprises (i) a housing, (ii) a gate structure within the housing and configured to engage the cap, (iii) a biasing element configured to bias the gate structure toward the cap, and (iv) a locking component inside of the housing. The locking component is in a locked configuration after the head is attached.

Another embodiment of the invention is directed to an attachment device comprising a cap element comprising a cap and a rod extending from the cap element, a base comprising a central hole, and an engagement member, wherein the rod extends through the central hole in the base and is coupled to the engagement member. The attachment device has an axial pull strength of greater than about 125 lbs.

Another embodiment of the invention is directed to an attachment device having a base (comprising, for example a cylinder) with a maximum lateral dimension (e.g., a diameter in the case of a cylinder or a width in the case of a block shape) of at most 8 mm, the base having an end (e.g., a flat end), and an engagement member attached to the flat end of the base, the engagement member configured to engage with a portable article. The attachment device has an axial pull strength of greater than about 125 lbs. In some embodiments, the base may be in the form of a cylinder, block, etc. Further, the end of the base may be flat, uneven, etc.

Another embodiment of the invention is directed to an attachment device for securing a portable article, the attachment device having a base comprising a cylinder shape, the base having a recess to receive a securing element, and an engagement member comprising a threaded post. The attachment device has an axial pull strength of greater than about 125 lbs.

Another embodiment of the invention is directed to a method comprising obtaining a portable article, and an attachment device having an axial pull strength of greater than about 125 lbs that is attached to the portable article, wherein the attachment device comprises a base extending from the portable article, and attaching a head to the attachment device by a single motion, wherein the head comprises a housing and a locking component inside of the housing, and further wherein the locking component is in a locked configuration after the head is attached.

Another embodiment of the invention is directed to a security system comprising a portable article having a housing and a chassis disposed within the housing, and an attachment device attached to the portable article, wherein the attachment device is attached to the chassis through a hole in the housing. The attachment device has an axial pull strength of greater than about 125 lbs.

Another embodiment of the invention is directed to a locking head for use with an attachment device having an axial pull strength of greater than about 125 lbs. The locking head comprises a housing, a securing element associated with the housing, and a locking component associated with the housing, wherein the locking head is capable of securing to the attachment device upon a single movement of the locking head, using the securing element.

These and other embodiments of the invention are described in further detail below.

BRIEF DESCRIPTION OF THE DRAWINGS

FIGS. 5F-1 through 5F-5 show various dimensions of attachment devices according to embodiments of the invention.

These and other embodiments are described in further detail below in the Detailed Description. In the Figures, like numerals may designate like elements and descriptions of like elements may not be repeated for all Figures.

DETAILED DESCRIPTION

Figure 1:
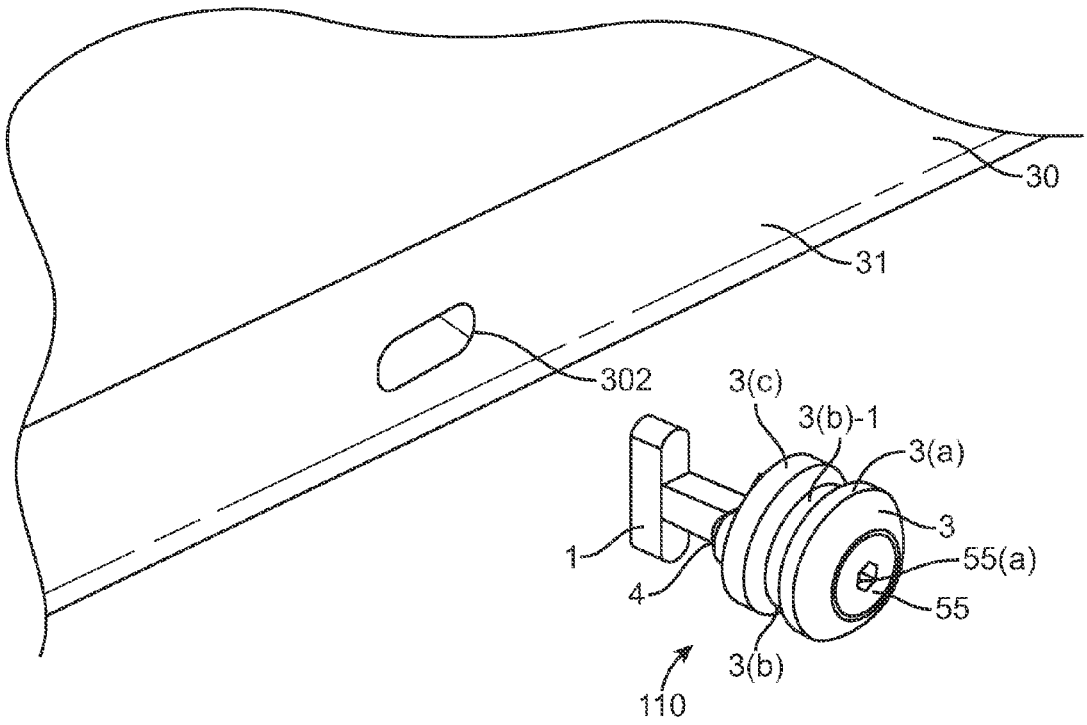
FIG. 1 is a perspective view including a portion of a portable article and an attachment device according to an embodiment of the invention.

Embodiments of the invention are directed to security apparatuses, methods for making and using such security apparatuses, and systems using such security apparatuses. The security apparatuses can be used to prevent or deter the theft of devices such as portable electronic devices.

One embodiment of the invention is directed to a security apparatus comprising an attachment device comprising an engagement device having a base including a cap, and also a head (e.g., a "locking head"). The head comprises (i) a housing, (ii) a gate structure within the housing and configured to engage the cap of the base, (iii) a biasing element configured to bias the gate structure toward the cap, and (iv) a locking component inside of the housing.

A security apparatus according to an embodiment of the invention may comprise a head and a security device. The head and the security device may be physically (e.g. using a pin or other suitable connection) and/or operationally (e.g. wirelessly, etc.) coupled together.

The security device may comprise a cable, or some other type of device to provide security. If the security device comprises a cable, then the cable may be secured to an immovable object such as a desk or cabinet so that a portable electronic device coupled to the cable cannot be removed. The cable may comprise stainless steel, carbon steel, Kevlar®, or some other type of strong material. In exemplary embodiments, the strong material may be chosen to have high tensile strength and/or cut resistance strength.

In another embodiment, the security device may comprise a wireless device such as a wireless transmitter and/or receiver. The wireless device may be used in a proximity detection system or a motion detection system. For example, a motion detector could present in the wireless device so that when the motion detector moves, an associated alarm is triggered. The alarm may be in the security device or may be external to the security device. In another embodiment, there may be a base device associated with the wireless device, and these components may be used in a proximity detection system. Wireless signals may be transmitted between the security device and the base device, and when these devices are separated by a predetermined distance, an associated alarm (e.g., an audible alarm) may be triggered. The alarm could be in the base device or in the security device. The electronics associated with such wireless systems are known to those of ordinary skill in the art.

The head in the security apparatus may be a locking head. A locking head according to an embodiment of the invention may comprise a locking component (e.g., a locking mechanism) such as a key locking component or a combination locking component disposed within it. As used herein, a "locking component" may comprise one or more structures suitable for causing the head to be in locked and unlocked configurations (i.e., locked or unlocked states). Various types of locking heads are described in further detail below.

The portable article that is to be secured may comprise any suitable article, such as a portable device (e.g., a portable electronic device). Examples of such articles comprise portable computers such laptop, tablet, desktop, and server computers, flat panel televisions, projectors, monitors, portable music players, printers, external hard-drives, cell phones, etc. Other types of articles may include medical devices that may or may not have electronics in them, industrial devices such as power or pneumatic tools, or sporting goods (bicycles, golf equipment such as golf bags, hockey equipment, etc.). In exemplary embodiments, the portable article that is to be secured may be a hand-carried article (i.e., an article capable of carried by a typical user without assistance).

Figure 11:
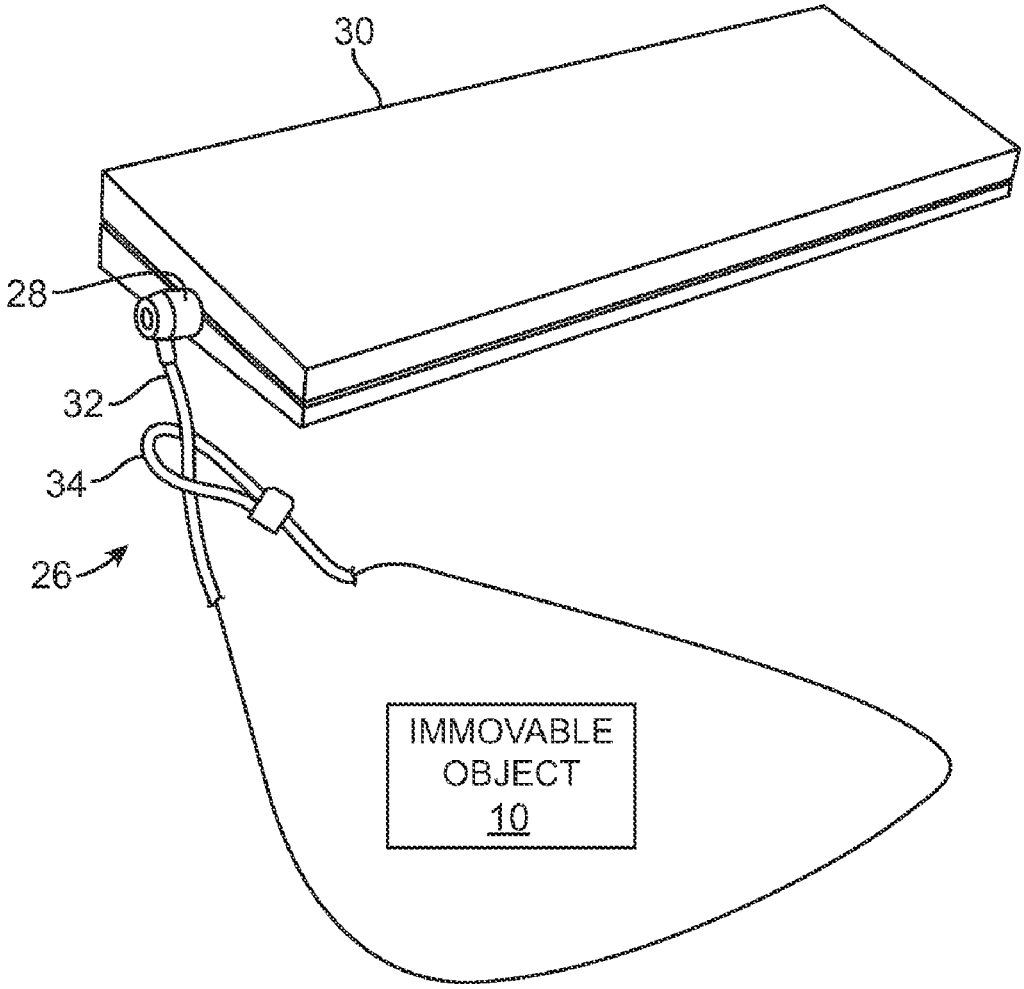
FIG. 11 shows a system according to an embodiment of the invention.

FIG. 11 shows a system comprising a portable article 30 and a security apparatus 26 that is used to secure the portable article 30 to an immovable object 10 such as a desk leg or the like. The security apparatus 26 comprises a head 28 and a cable 32 coupled to the head 28, which may be a locking head in this example. A loop 34 is at a terminal end of the head 28. The cable 32 may comprise a strong material such as stainless steel or Kevlar™.

To secure the portable article 30 to the immovable object, the cable 32 may be wrapped around the immovable object and the head 28 may pass through the loop 34.

FIG. 1 shows a close up view of parts of a security apparatus according to an embodiment of the invention. FIG. 1 shows a portable article 30 including a portable article housing 31 comprising an aperture 302. As used herein, in the above described embodiments and in other embodiments, an "aperture" may include a blind aperture or a through aperture. A through aperture may be in the form of a hole, or a recess. The aperture 302 may be generally rectangular and may have dimensions of about 3 mm by about 7 mm in some embodiments. In some embodiments, the aperture may contain a threaded section such as a threaded hole, or may allow outside access (i.e., access from outside of the housing) to a threaded hole, as described in further detail below. In other embodiments the aperture may be non-threaded and be configured to be secured by a non-threaded engagement member such as a T-bar, as described below.

An attachment device 110 may attach to the portable article 30 via the aperture 302. In this embodiment, the attachment device 110 comprises a base 3 (e.g., a spur) having a flat end opposite a tapered end. The base 3 can comprise a cap 3(*a*) and a ring structure 3(*c*), which define a recess 3(*b*). The cap 3(*a*) and the ring structure 3(*c*) may have similar diameters. In some implementations, the cap 3(*a*) and the ring structure 3(*c*) may each comprise cylinders with a substantially (axially) tapered end and a substantially flat end opposite the substantially tapered end. In other implementations, one or more ends of the cap 3(*a*) or the ring structure 3(*c*) may comprise a curved surface or other uneven shape (i.e., not flat). The lateral side wall of each of the ring structure 3(*c*) and the cap 3(*a*) may be tapered (as in a cone shape) or may comprise a straight wall. In other embodiments, the base may comprise other suitable shapes, such as a block (e.g. a cap having a block shape and a ring structure having a block shape), a rectangular structure, an octagonal shape, etc.

In the embodiment illustrated in FIG. 1, the cylinders comprising the ring structure 3(*c*) and the cap 3(*a*) are facing in the same direction. That is, the direction of travel from the flat end of the cap 3(*a*) to the tapered end of the cap 3(*a*) is the same direction of travel as from the flat end of the ring structure 3(*c*) to the tapered end of the ring structure 3(*c*). That is, the cap 3(*a*) and the ring structure 3(*c*) can be axially aligned. The recess 3(*b*) can be formed by the space between the tapered end of the ring structure 3(*c*) and the flat end of the cap 3(*a*), which may be joined together (and held apart to form the recess) by a central cylinder 3(*b*)-1. Thus, the recess 3(*b*) may be located between the cap 3(*a*) and the ring structure 3(*c*). The tapered end of the ring structure 3(*c*) may taper from the width of the ring structure 3(*c*) to the width of the central cylinder 3(*b*)-1, at which point the ring structure 3(*c*) may be joined to the central cylinder 3(*b*)-1. In some embodiments, the cap 3(*a*) and the ring structure 3(*c*) may have approximately equal lengths, so that the recess is located approximately in the middle of the length of the base 3. In some embodiments of the invention, the central cylinder 3(*b*)-1 may include a lateral side wall that may be tapered or may comprise a straight wall.

In certain embodiments, the cap 3(*a*), the central cylinder 3(*b*)-1, and the ring structure 3(*c*) may be structurally discrete or non-discrete. That is, the cap 3(*a*), the central cylinder 3(*b*)-1, and the ring structure 3(*c*) may together be formed of one piece of material, such as one machined metal structure with tapered portions and a recess. In another embodiment, each of the cap 3(*a*), the central cylinder 3(*b*)-1, and the ring structure 3(*c*) may be formed separately, and joined together (such as by glue, rivets, pins, etc.). In a further embodiment, the central cylinder 3(*b*)-1 and either the cap 3(*a*) or the ring structure 3(*c*) may comprise one continuous material, which can be joined to the third portion. For example, the ring structure 3(*c*) and the central cylinder 3(*b*)-1 can be formed of a single machined metal part, and then be joined to the cap 3(*a*) by any suitable process (e.g. glue, rivets, pins, etc.).

The design of the base of the attachment device, as disclosed herein, contains many advantages. By having one end of the ring structure 3(*c*) shaped as a flat surface, the base may conform to the shape of the housing 30 to allow for a secure fit while securing the portable article 30. Similarly, the flat end of the cap 3(*a*) (i.e., the recess-facing end) can conform to the clamping structure (e.g. the gates as described below) of a locking head. In certain embodiments, the flat end of the cap 3(*a*) can be a substantially planar surface that is approximately 90 degrees from the lateral side wall of the cap 3(*a*). This flat end of the cap 3(*a*) may be approximately parallel to the housing 31 when secured to the slot 302, and the flat end structure will provide a strong surface for the locking head to hold onto while securing the portable article 30. The locking head is unlikely to be able to slip or be pulled off of the cap 3(*a*). Furthermore, the tapered ends of the cap 3(*a*) and the ring structure 3(*c*) may assist in guiding the locking head onto the correct position around the base while securing the portable article 30, resulting in easier locking and unlocking by a user (as described in further detail below). The lateral side wall(s) of the attachment device 110, such as the lateral side walls of the cap 3(*a*) and the ring structure 3(*c*), may comprise a smooth surface, such as a polished metal surface. This smooth surface can allow a locking head to rotate about the attachment device, preventing a person from twisting the attachment device off of the housing 31 (i.e., forcibly unsecuring the security apparatus) by twisting the locking head.

In certain embodiments, an engagement member 1 in the form of a T-bar extends axially away from the ring structure 3(*c*), as shown in FIG. 1. In certain embodiments, the engagement member 1 may comprise other shapes, such as a J-hook (or alternatively an L-hook).

A coupling element 55 in the form of a screw can pass through an axial hole (not shown) in the base 3 and into a threaded axial hole (not shown) in the engagement member 1 and can secure the engagement member 1 to the base 3. As shown, the end surface of the coupling element 55 is flat and can form an end surface of the base of the attachment device 110. The end surface of the coupling element 55 can thus comprise a flat portion of the tapered end of cap 3(*a*). In this embodiment, the cap 3(*a*) can also cover all lateral edges of the end of the coupling element 55 so that the coupling element cannot be turned by rotation or twisting of the locking head (not shown) that attaches to the attachment device 110. In other embodiments, the coupling element 55 can entirely cover the tapered end of the cap 3(*a*). The end surface of the coupling element 55 may also include a depression or socket 55(*a*) for receiving an external rotating structure, such as a screwdriver, an end of an Allen wrench, or the like. In certain embodiments of the invention, the external rotating structure may comprise a portion or extension of a key for the locking component, and/or the external rotating structure may be integrated or otherwise associated with the coupling element 55 or other portion of the attachment device.

One or more stabilizing elements 4 (such as one or more anti-rotation pins) may be inserted into the aperture 302 to stabilize the attachment device against the housing 31, so that the engagement member 1 cannot be readily withdrawn from the aperture 302. The T-bar shape of the engagement member can provide strong security by contacting two opposing sides (e.g., the longer sides such as the sides measuring about 7 mm) of the aperture 302. This prevents sagging or bulging of the attachment device 110, such as due to contact with only one side of aperture 302, as could potentially happen in the case where the attachment device comprises a J-hook (described in further detail below) as an engagement mechanism instead of a T-bar.

The attachment device 110 can be secured to the portable article 30 via the aperture 302 by loosening the coupling element 55 so that the engagement member 1 is able to pass through the aperture 302. At this point, the coupling element 55 and the engagement member 1 may still be attached to each other. Once the engagement member 1 is inside of the aperture 302, the coupling element 55 can be tightened so that the engagement member 1 and the base 3 are brought closer together, such that the bottom of the ring structure 3(*c*) contacts the side surface of the housing 31 of the portable article 30.

The attachment device 110 in FIG. 1 and in other embodiments, may have any suitable dimensions. For example, in some embodiments, the attachment device 110 may have dimensions less than about 1 $cm^3$ or even 0.5 $cm^3$. For example, the dimensions may be substantially equal to or less than about 8 mm×6 mm×6.5 mm in some embodiments.

Figure 2:
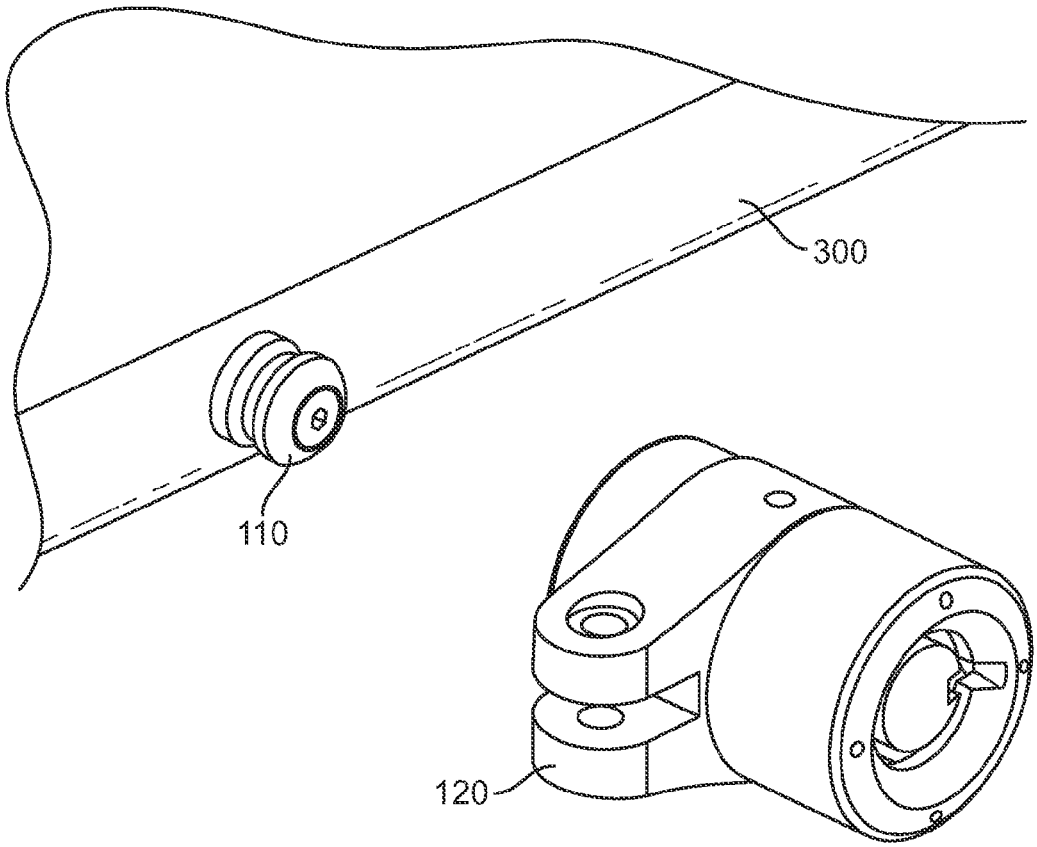
FIG. 2 is a perspective view including a portion of a portable article and an attachment device secured to the portable article. A head for attaching to the attachment device is also shown.

FIG. 2 shows the attachment device 110 attached to a portable article 300. Once the attachment device 110 is attached to the portable article 300, the head 120 can be secured to the portable article 300 via the attachment device 110. As will be described in detail below, one or more gate structures in the head 120 may clamp down on the previously described cap when a locking component in the head 120 is in a locked configuration. The head 120 may "click" or produce other suitable sounds, to indicate that it has been locked. This can allow for "one click" (or "one step") fast locking of the head 120 to the attachment device 110, such as by a single linear motion (e.g., a single linear forward motion) of the head 120 towards the portable article 300. In certain implementations, no key may be necessary to lock the head 120 against the attachment device. Rather, locking of the head 120 may be achieved by the single linear motion (i.e., only "one step" is necessary to lock the head), and a key may only be required to unlock the head 120.

Figure 3A:
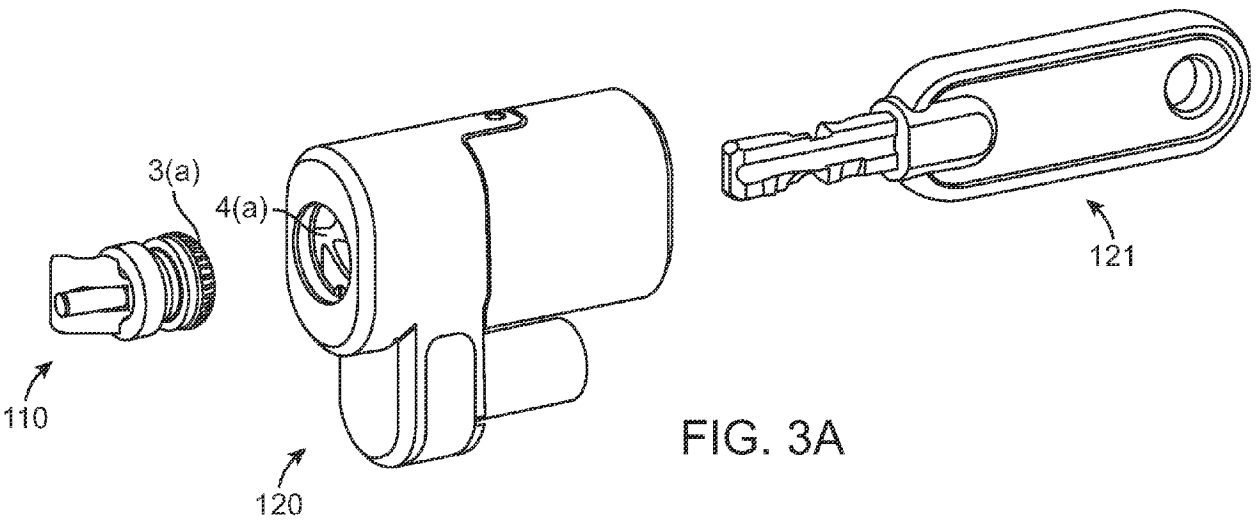
FIG. 3A shows a front perspective view of a key, a head, and an attachment device.

FIG. 3A shows a front perspective, exploded view of parts of a security apparatus including an attachment device 110, a head 120, and a key 121. A front hole 4(*a*) in the head 120 is configured to receive a cap 3(*a*) in the attachment device 110. The head 120 may include any suitable dimensions (e.g., 30 mm×25 mm×12.5 mm) (L×H×W).

Figure 3B:
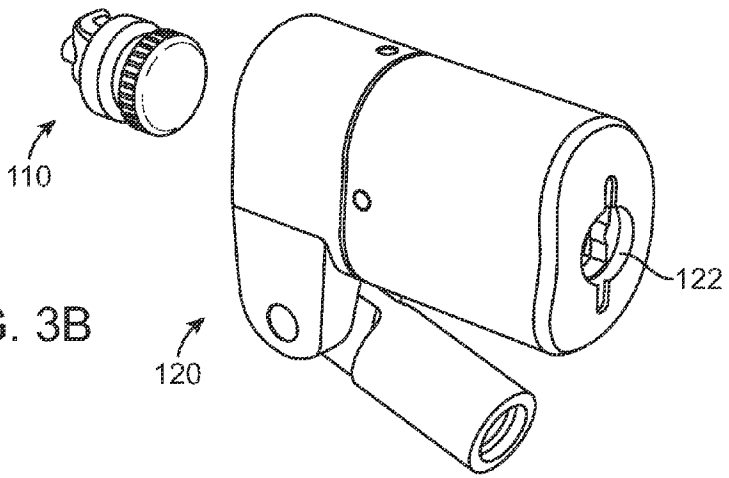
FIG. 3B shows a rear perspective view of a head, and an attachment device.

FIG. 3B shows a rear perspective view of the head 120 and the attachment device 110. A keyhole 122 is at a rear section of the head 120. The attachment device 110 in FIG. 3A is different than the attachment device 110 in FIGS. 1 and 2. The specific features of the attachment device 110 in FIGS. 3A and 3B are described in further detail below.

Figure 4A:
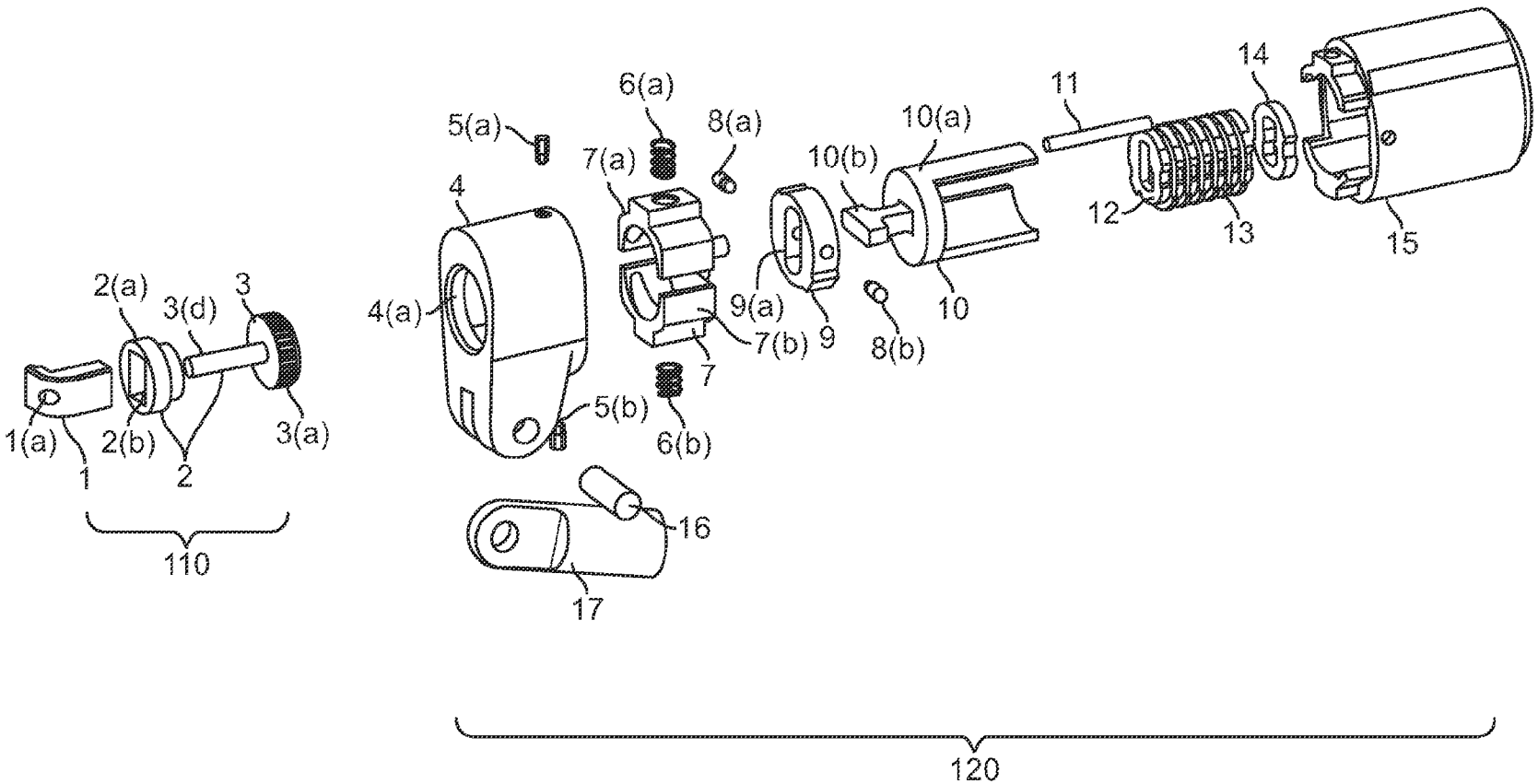
FIG. 4A shows an exploded view of a security apparatus according to an embodiment of the invention.

FIG. 4A shows an exploded view of elements of a security apparatus according to embodiments of the invention.

FIG. 4A shows an attachment device 110 having a base 2 and an engagement member 1 comprising a central axial hole 1(*a*). The base 2 can comprise a ring structure 2(*a*) (e.g. a lower base), a central axial hole 2(*b*), and a cap element 3 comprising a cap 3(*a*) and a rod 3(*d*) extending axially from a center of the cap 3(*a*). The ring structure 2(*a*) is between the cap 3(*a*) and the end of the engagement member 1. The rod 3(*d*) extends axially through the hole 2(*b*) in the base 2, and into the hole 1(*a*) in the engagement member 1. An end of the rod 3(*d*) may be threaded so that it is complementary to a threaded hole 1(*a*) in the engagement member 1. As described herein, the engagement member may comprise a J-hook, a T-bar, a threaded post, or other suitable shape.

Referring to FIG. 4A, the head 120 comprises a first housing portion 4 comprising a hole 4(*a*), and a second housing portion 15, which are coupled together with assembly pins 5(*a*), 5(*b*), 8(*a*), 8(*b*) to form a housing. A ferrule 17 is coupled (in certain embodiments, rotatably coupled) to the first housing portion 4 using a hinge pin 16. In some embodiments, the ferrule 17 may comprise a multi joined cable ferrule, to allow for easy securing of the head 120 from any orientation. The multi joined ferrule 17 may comprise two or more hinges, or may comprise a hinge connecting an outer ferrule portion to an inner ferrule portion. This inner ferrule portion may, in turn, rotatably connect to the first housing portion 4. A cable (not shown) can be connected to the ferrule 17. As illustrated by this embodiment, the housing of the head 120 may comprise one or several pieces.

As shown in FIG. 4A, the head 120 can also have a number of internal components. In certain embodiments, the head 120 can include a securing element, to securely attach to the attachment device. As used herein, a "securing element" may comprise one or more structures to actively engage a fixed member in a locked position (i.e., one or more structures for securing a head to an attachment device). For example, a securing element in the head 120 may comprise a gate assembly 7. First and second opposed gate structures 7(*a*), 7(*b*) forming the gate assembly 7 can be at a front region of the head 120. In the absence of other external forces, they can be biased inwardly by springs 6(*a*), 6(*b*) (examples of biasing elements), which are located between the first housing portion 4 and the first and second gate structures 7(*a*), 7(*b*). The first and second opposed gate structures 7(*a*), 7(*b*) can be configured to engage a base of an attachment device, such as by inwardly clamping onto a recess in the base while the head 120 is in a locked configuration. While in this configuration, the first and second gates structures 7(*a*), 7(*b*) may be biased towards the base (e.g., biased inwards and towards each other). In some embodiments, the first and second gate structures 7(*a*), 7(*b*), can form a cavity which can fully surround the base of an engagement member. In certain implementations, once the head 120 is securely attached to the attachment device, the base of the attachment device may be inaccessible to users (due to being entirely located within the gate assembly cavity and being fully surrounded by the head). The gate assembly may be similarly inaccessible to users, as it can be fully surrounded by the housing of the head 120, preventing unauthorized movement of the gates by hand or using lock-picking tools. In exemplary embodiments, the head 120 may have other securing elements, such as ball bearings, one or more internal adjustable wrenches, clamps, adjustable belts, etc. In certain embodiments, the head 120 may not require biasing elements for the securing element (i.e., the securing element may engage a fixed member without the use of biasing elements). In some implementations, the securing element may comprising a selectively deformable material for receiving an attachment device, piezoelectric material, hinges, etc.

Figure 5B:
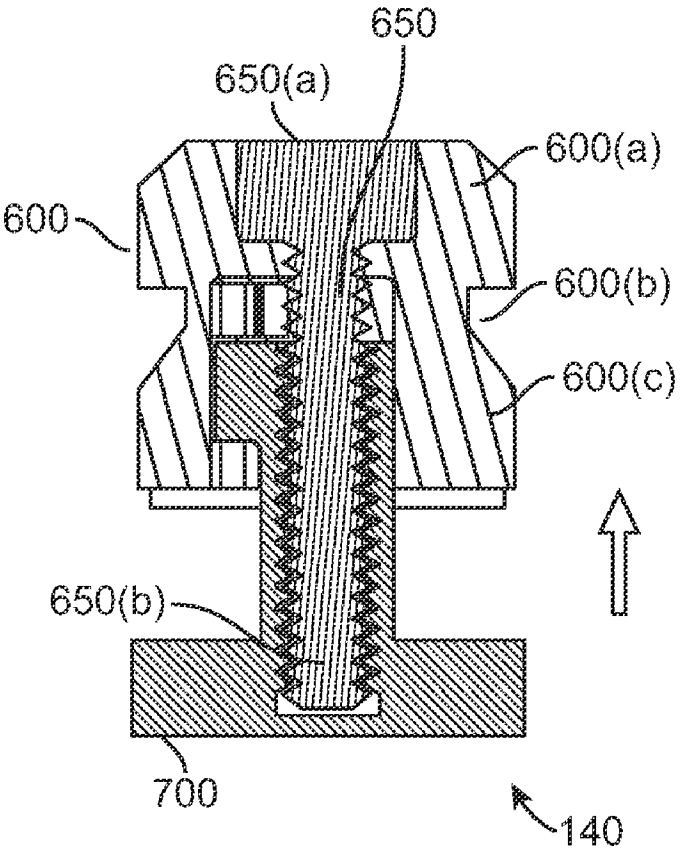
FIG. 5B shows a side, cross-section view of an attachment device according to another embodiment of the invention.

Referring again to FIG. 4A, a lock plate 9 comprising a central hole 9(*a*) lies between the first and second gate structures 7(*a*), 7(*b*) and at least a portion of an actuator and lock holder assembly 10. The actuator and lock holder assembly 10 may comprise an actuator 10(*b*) in the form of a cam which extends forward from a lock holder assembly 10(*a*). In certain implementations of the invention, the actuator 10(*b*) may comprise a cam follower, an eccentric follower, an eccentric cam, a T-bar shaped structure, or other suitable structure. The actuator 10(*b*) passes through the central hole 9(*a*) of the lock plate 9. A locking component 12 in the form of a disk locking component comprising a number of disks 13 and a lock pin 11 is housed in the lock holder assembly 10(*a*). Another lock plate 14 is at a rear region of the head 120. Although one specific disk locking component is shown in FIG. 4, it is understood that other types of locking components (e.g., a tumbler and pin locking component) can be used in other embodiments of the invention.

The use of two opposing first and second gate structures 7(*a*), 7(*b*) provides for a number of advantages. This configuration is better than providing only one gate structure or ball bearings as a securing mechanism. While an embodiment with one gate structure would be acceptable, it can be potentially easier to disengage a locking head from an attachment device when only one gate structure or ball bearings are used in the locking head. For example, an unauthorized user can try and disengage the locking head from an attachment device by pulling the cable attached to the locking head away from the attachment device in an axial direction, while tapping the locking head in a radial direction with a small hammer or the like. This can potentially cause the single gate structure or ball bearings to move back and forth within the locking head, thereby allowing them to disengage with the attachment device at some point. Once disengaged, the pulling of the locking head in the axial direction can allow the locking head to separate from the attachment device. In contrast, when two opposing gate structures are used in a locking head, any tapping of the locking head in the radial direction will cause one gate structure to move towards the attachment device, while the other facing gate structure moves away from the attachment device. Thus, even when the lock head is tapped by a hammer or the like, there is always at least one gate structure that engages the attachment device, thus preventing the unauthorized user from separating the locking head from the attachment device by pulling on the cable attached to the locking head.

Figure 4B:
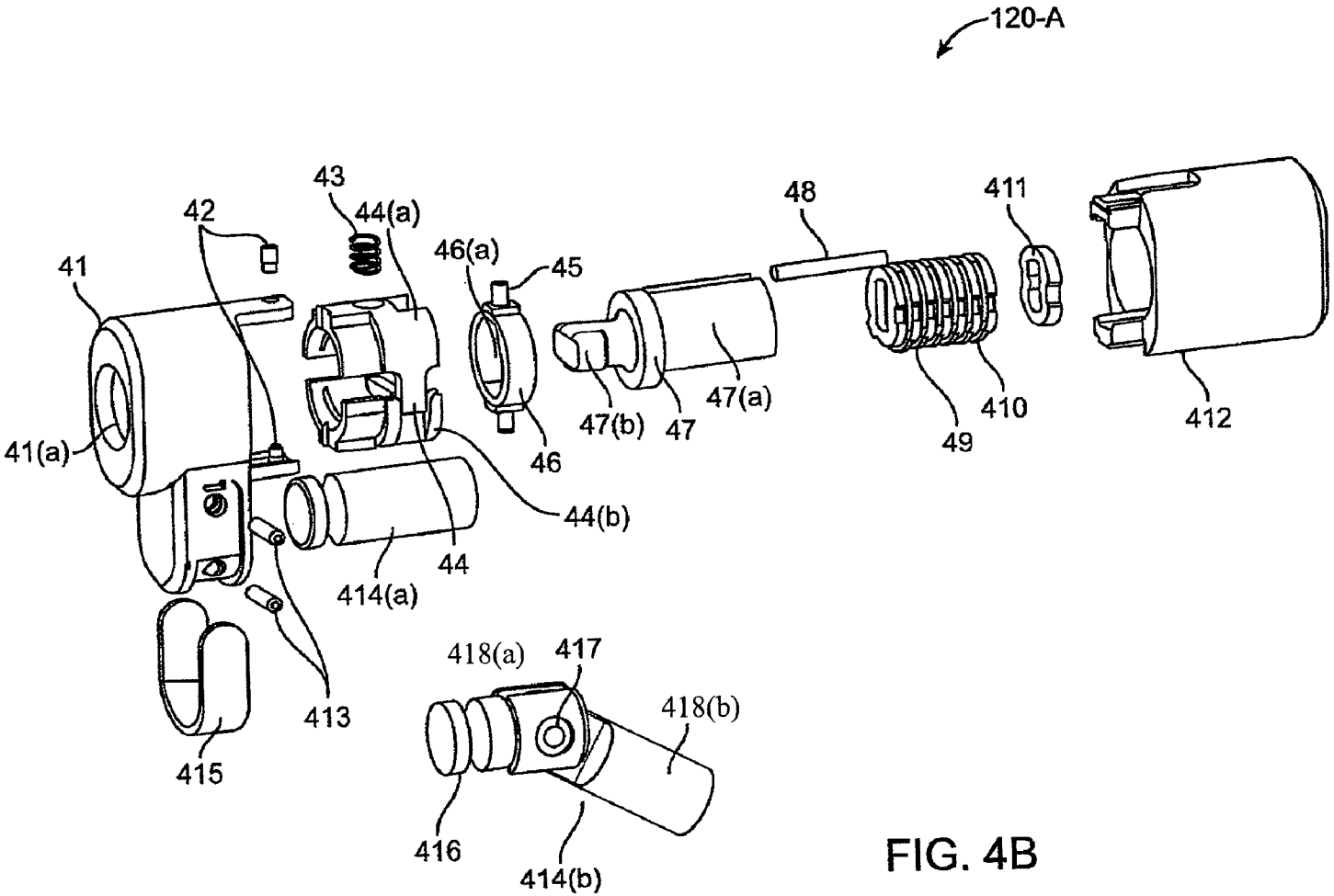
FIG. 4B shows an exploded view of a locking head according to another embodiment of the invention.

FIG. 4B shows an exploded view of a security head 120-A according to an implementation of the invention. The embodiments shown herein can provide "keyless locking" as disclosed above (i.e., one step locking) with high security and reduced likelihood of lock error (e.g. binding of the gates, etc.). Referring to FIG. 4B, the head 120-A comprises a first housing portion 41, such as a cable ring, comprising a hole 41(*a*), and a second housing portion 412, which are coupled together with assembly pins 42 to form a housing. A ferrule 414(*a*) is rotatably coupled to the first housing portion 41 using one or more hinge pins 413. The hinge pins 413 and portions of the first housing portion 41 may be covered by a ring cap 415, for security. The ferrule 414(*a*) can be rotatably connected to a swivel adapter 416 of a swivel ferrule 414(*b*) (e.g., a multi jointed ferrule), to allow for easy securing of the head 120 from any orientation. The swivel ferrule 414(*b*) can in turn comprise a first swivel portion 418(*a*) and a second swivel portion 418(*b*), connected by a hinge pin 417. A cable (not shown) can be connected to the swivel ferrule 414(*b*). As illustrated by this embodiment, the housing of the head 120 may comprise one or several pieces.

As shown in FIG. 4B, the head 120-A can also have a number of components inside of the housing or otherwise associated with the housing. For example, one or more components may be operationally coupled to, or outside of, the housing. In certain embodiments, the head 120-A can include a securing element, such as a gate assembly 44, to securely attach to the attachment device. First and second opposed gate structures 44(*a*), 44(*b*) forming the gate assembly 44 can be at a front region of the head 120. In the absence of other external forces, they are biased inwardly by spring 43 (examples of biasing elements), which is located between the first housing portion 41 and the first gate structure 44(*a*). In certain embodiments, one gate (e.g. second gate structure 44(*b*)) may remain fixed while the other gate (e.g. first gate structure 44(*a*)) moves inwardly and outwardly. In exemplary embodiments, both first and second gate structures 44(*a*), 44(*b*) can move inwardly and outwardly, and the gate assembly 44 may be biased by both spring 43 and a second spring (not shown). In other embodiments, the head 120-A may have other securing elements, such as ball bearings, one or more internal adjustable wrenches, clamps, adjustable belts, etc.

Referring again to FIG. 4B, a lock plate 46 comprising a central hole 46(*a*) lies between the gate assembly 44 and at least a portion of an actuator and lock holder assembly 47. The lock plate 46 may be held in place (e.g., coupled) with respect to the second housing portion 412 by one or more assembly pins 45. The actuator and lock holder assembly 47 may comprise an actuator 47(*b*) in the form of a cam which extends forward from a lock holder assembly 47(*a*). The actuator 47(*b*) (which may have forms other than a cam as shown in FIG. 4B) passes through the central hole 46(*a*) of the lock plate 46. A locking component 49 in the form of a disk locking component comprising a number of disks 410 is housed in the lock holder assembly 47(*a*). A lock pin 48 may be disposed in a slot within the lock holder assembly 47(*a*). Another lock plate 411 is at a rear region of the head 120. Although one specific disk locking component is shown in FIG. 4B, it is understood that other types of locking components (e.g., a tumbler and pin locking component), or other configurations of disk locking components, can be used in other embodiments of the invention.

The attachment devices, as well as parts of the locking heads, shown herein may be made of any suitable materials, including zinc, stainless steel or nickel alloys. Furthermore, as the attachment device can be made small (while providing superior security strength), the lock head itself may be configured small, to allow for greater portability by the user.

FIGS. 5A-5F show various views of certain embodiments of attachment devices.

Figure 5A:
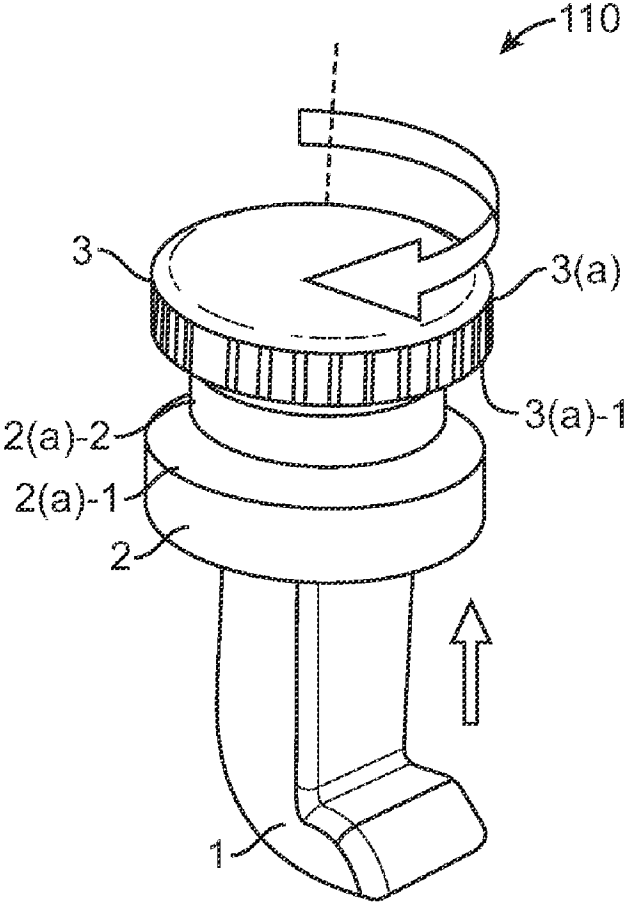
FIG. 5A shows a top perspective view of an attachment device.
Figure 5D:
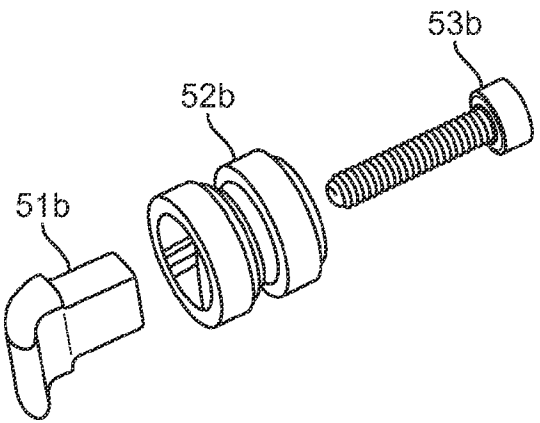
FIGS. 5C through 5E show exploded views of attachment devices according to embodiments of the invention.

FIG. 5A shows an outside side view of an embodiment of an attachment device comprising J-hook. The attachment device may have a base 3, which includes a ring structure 2 and a cap 3(*a*). As shown in FIG. 5A, the ring structure 2 of the attachment device may also include a large portion 2(*a*)-1 and a relatively smaller portion 2(*a*)-2. The large portion 2(*a*)-1, the smaller portion 2(*a*)-2, and the cap 3(*a*) may form a circumferential recess that can receive a gate structure. The cap 3(*a*) can include a number of ridges 3(*a*)-1 so that a user can grip it and turn it.

FIG. 5B shows a side cross-sectional view of an embodiment of an attachment device comprising a T-bar. As shown in FIG. 5B, an embodiment of the attachment device 140 may comprise a base 600 (e.g., a spur) connected to an engagement member 700. The base 600 can include a cap 600(*a*) and a ring structure 600(*c*) which can define a recess 600(*b*) in the base 600. The recess 600(*b*) can comprise a trench or channel that extends the entire diameter of the base, or the recess 600(*b*) can comprise one or more discrete indentations (e.g., divots, trenches, etc.) in the base. The recess 600(*b*) can be configured to receive a securing element of a locking head. The securing element may comprise, for example, a gate assembly as described herein. The securing element may be coupled to the head, by extending portions of the securing element into the recess 600(*b*). This can prevent removal of the locking head from the attachment device, without first unlocking the securing element. A coupling element 650, such as a screw, can extend at least partly through a central opening of the base 600. One end 650(*a*) of the coupling element 650 can be accessed from outside of the base 600, such as to engage an external rotating structure (not shown) such as a hex key, other type of wrench, or a screwdriver. The other end 650(*b*) of the coupling element 650 may couple to the engagement member 700. In exemplary embodiments, the engagement member 700 may comprise a T-bar shape. The T-bar shape may have suitable dimensions for securely attaching to a portable article. For example, a bottom view cross-section of the T-bar may have a width of about 2.4 mm, and a length of about 6.4 mm. For apertures in portable article housings as disclosed herein, the T-bar shape of the engagement member 700 may provide about 6.7 $mm^2$ of contact surface area with the inside of the housing.

In one example, the coupling element end 650(*b*) may comprise a threaded screw, which engages a threaded hole in the engagement member 700. Thus, rotating the coupling element 650 (using, for example, a hex key) will move the engagement member into or away from the base 600. The T-bar shape of engagement member 700 (or other suitable shape, such as a J-hook) may then be pulled towards the inside of the housing of a portable article, clamping the housing between the T-bar extensions of the engagement member 700 and the flat end of the ring structure 600(*c*) (i.e., the housing is clamped between the engagement member 700 and the base 600). In one implementation, clamping pads may extend from the flat end of the ring structure 600(*c*), so that the attachment device 140 may be secured to the portable article by compressing the housing between the clamping pads and the engagement member 700.

Figure 5C:
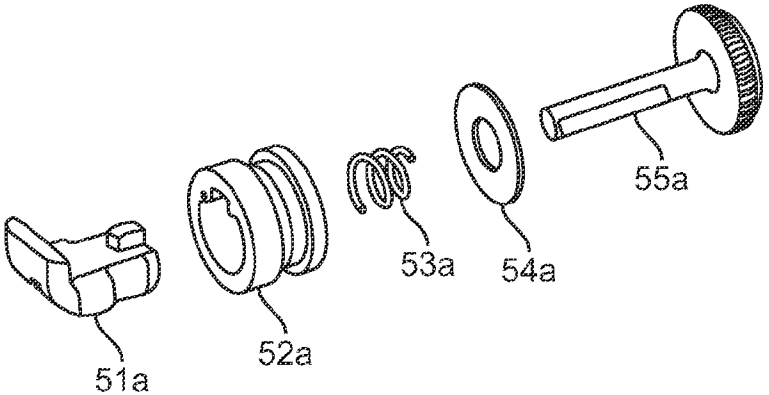

FIG. 5C shows an exploded perspective view of an embodiment of an attachment device comprising a thumbscrew as a coupling element, and a J-hook. As shown in FIG. 5C, the attachment device can comprise a base 52*a* coupled to an engagement member 51*a* in the form of a J-hook. The attachment device can also comprise a thumbscrew 55*a* with an integrated coupling element (e.g., a rod), for loosening and tightening the engagement member 51*a*. A washer 54*a* (comprising rubber or other suitable material such as a soft metal) and a biasing element 53*a* (such as a compression spring) may hold the thumbscrew in place.

FIG. 5D shows an exploded perspective view of an embodiment of an attachment device comprising a screw as a coupling element, and a J-hook as an engagement member. As shown in FIG. 5D, the attachment device can comprise a base 52*b* coupled to an engagement member 51*b* in the form of a J-hook. The attachment device can also comprise a coupling element 53*b*, such as a socket head cap screw, for loosening and tightening the engagement member 51*b*. The threaded post portion of the coupling element 53*b* can extend through the center of the base 52*b*, to threadedly couple to a threaded hole (not shown) within engagement member 51*b*.

Figure 5E:
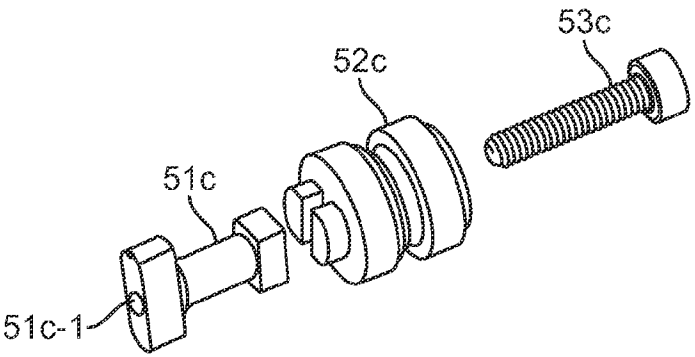

FIG. 5E shows an exploded perspective view of an embodiment of an attachment device comprising a screw as a coupling element, and a T-bar as an engagement member. As shown in FIG. 5E, the attachment device can comprise a head 52*c* coupled to an engagement member 51*c* in the form of a T-bar. The attachment device can also comprise a coupling element 53*c*, such as a socket head cap screw, for loosening and tightening the engagement member 51*c*. The threaded post portion of the coupling element 53*c* can extend through the center of the base 52*c*, to threadedly couple to a threaded hole 51*c*-1 within engagement member 51*c*. Thus, rotating the coupling element 53*c* may slide the engagement member 51*c* inwardly and outwardly from the base 52*c*.

Figures 1, 5F:
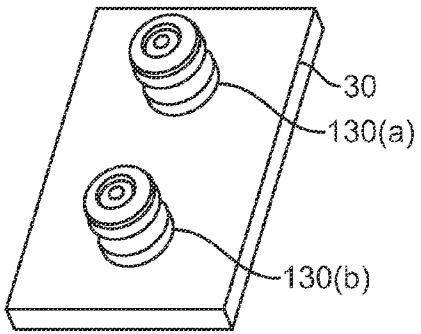
Figures 2, 5F:
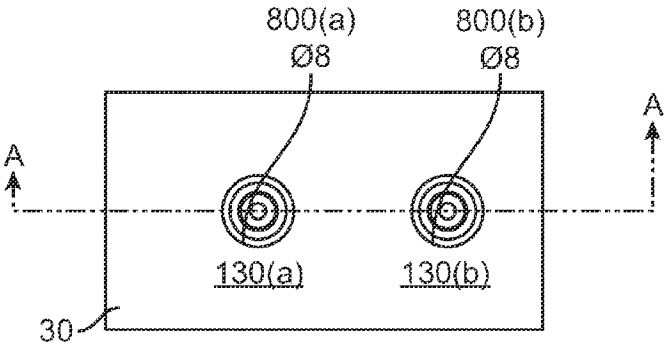
Figures 3, 5F:
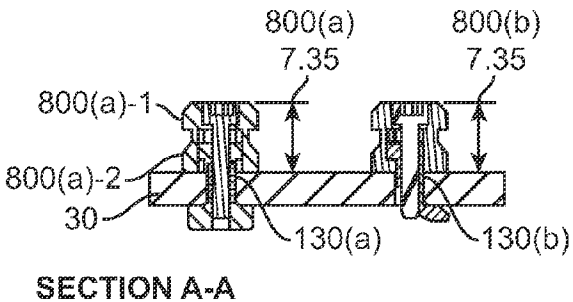
Figures 4, 5F:
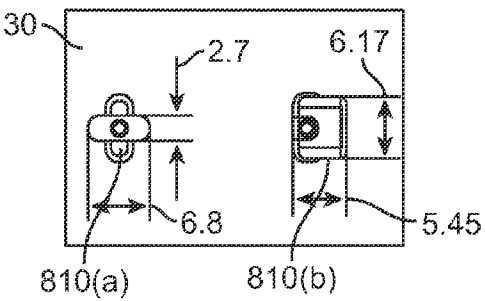
Figures 5, 5F:
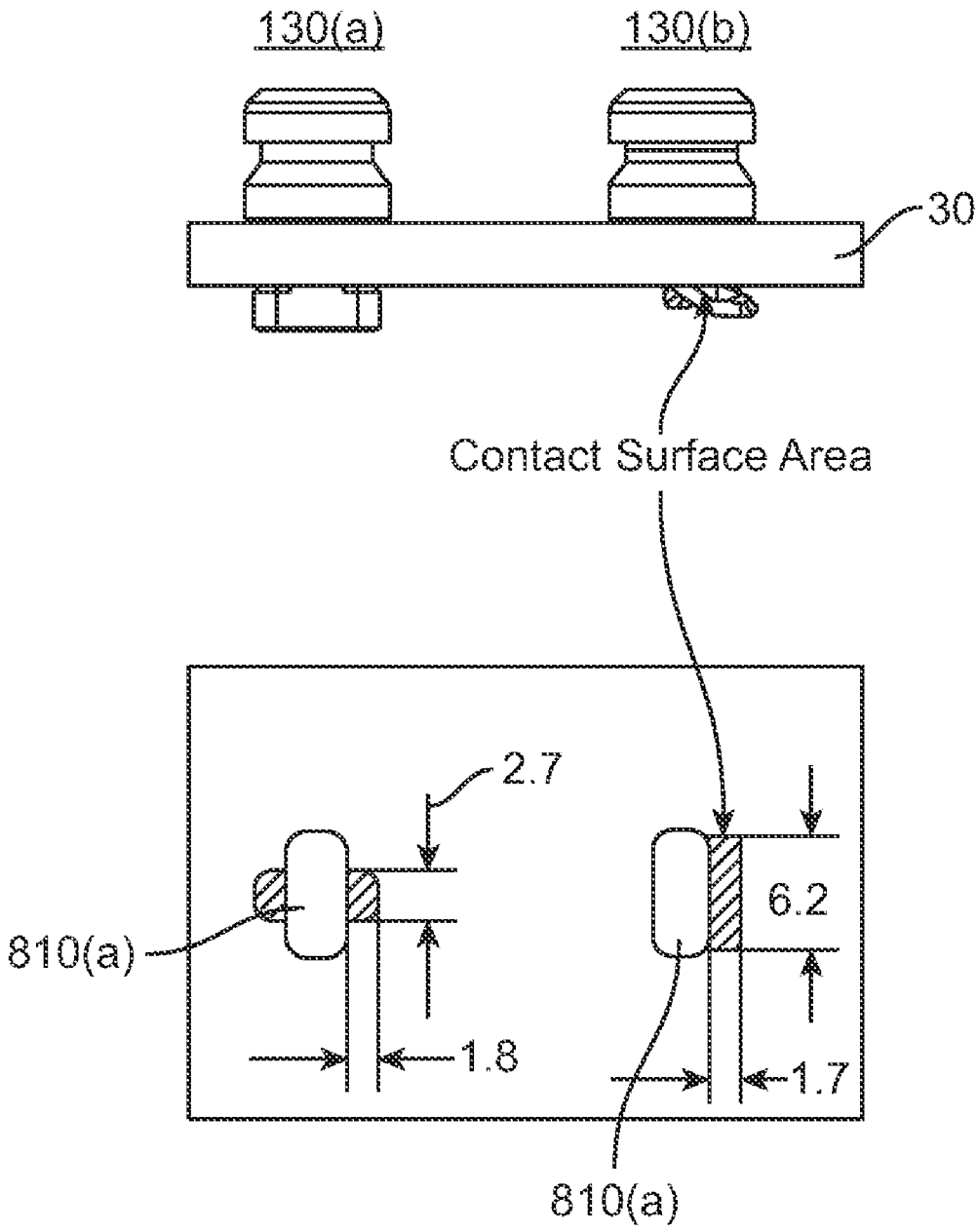

Referring to FIG. 5F, including FIGS. 5F-1 through 5F-5, various views are shown of exemplary attachment devices 130(*a*) and 130(*b*), each secured to a portable article housing 30. FIG. 5F-1 shows a top perspective view of an attachment device 130(*a*) using a T-bar shaped engagement member, and an attachment device 130(*b*) using a J-hook shaped engagement member. Other embodiments of attachment devices with other engagement member implementations (e.g. a screw, etc.) may have substantially similar dimensions as shown in FIG. 5F, or may have differing suitable dimensions.

FIG. 5F-2 shows an overhead view of the attachment devices 130(*a*) and 130(*b*). In exemplary embodiments, the diameter of the base 800(*a*) or 800(*b*) of the attachment device 130(*a*) or 130(*b*) may each comprise about 8 mm at its maximum lateral dimension. As used herein, "maximum lateral dimension" of a structure may comprise the dimension of the structure at its widest point as measured laterally (the innermost surface defining the recess in the base 800(*a*) or 800(*b*) may have a lateral dimension less than the maximum lateral dimension). For cylinder structures as shown herein, the maximum lateral dimension comprises a diameter. For other structures, such as block shapes, the maximum lateral dimension may comprise a lateral width. Thus, the maximum lateral dimension (e.g., maximum diameter) of the base 800(*a*) or 800(*b*) may be at most about 8 mm in some embodiments. Certain examples of the bases 800(*a*), 800(*b*) may have lateral dimensions up to about 8 mm, including within the range of 6 mm to 8 mm. Other examples of the base 800(*a*) or 800(*b*), according to embodiments of the invention, may have lateral dimensions of about 6-10 mm. Still another implementation may have a lateral dimension of less than 11 mm (e.g. 10.9 mm, 7.5 mm, 8 mm, etc.).

Referring to FIG. 5F-3, a cutaway side view of attachment device 130(*a*) and 130(*b*) is shown. The base 800(*a*) of the attachment device 130(*a*), and the base 800(*b*) of the attachment device 130(*b*) each extend past the housing 30 by a certain height. Embodiments of the bases 800(*a*), 800(*b*) may each have a height of approximately 7 mm (e.g., 7.35 mm). As used herein, the "height" of the base may comprise the amount the base would extend from a housing that the respective attachment device is secured to. For example, the height can comprise the distance from the flat end of the ring structure 800(*a*)-(2) to the outside edge (e.g., the flat portion) of the tapered end of cap 800(*a*)-1 of the base 800(*a*). In some examples, the base 800(*a*) or 800(*b*) may have a height of between approximately 6.5 mm to approximately 8.5 mm. In another example, the base 800(*a*) or 800(*b*) may have a height of less than approximately 11 mm (e.g. 10.5 mm, 8.3 mm, etc.). In certain embodiments of attachment devices, the base may have a height of at most about 7.5 mm.

FIG. 5F-4 shows side and bottom views of attachment devices 130(*a*), 130(*b*), each attached to a housing 30. The engagement member 810(*a*) of attachment device 130(*a*) is in the form of a T-bar, and has been rotated and pulled inwardly to securely attach the attachment device 130(*a*) to the housing 30. The engagement member 810(*b*) of attachment device

130(*b*) is in the form of a J-hook, and has been pulled inwardly to securely attach the attachment device 130(*a*) to the housing 30. FIG. 5F-5 shows side views and the bottom views of attachment devices 130(*a*), 130(*b*), to highlight the contact surface area of each engagement member 810(*a*), 810(*b*). In certain embodiments, the engagement member 810(*a*) may have a contact surface area with the housing 30 of approximately 7 square mm. In certain embodiments, the engagement member 810(*b*) may have a contact surface area with the housing 30 of approximately 10.2 square mm. Other embodiments herein may contemplate difference contact surface area sizes.

Figure 5H:
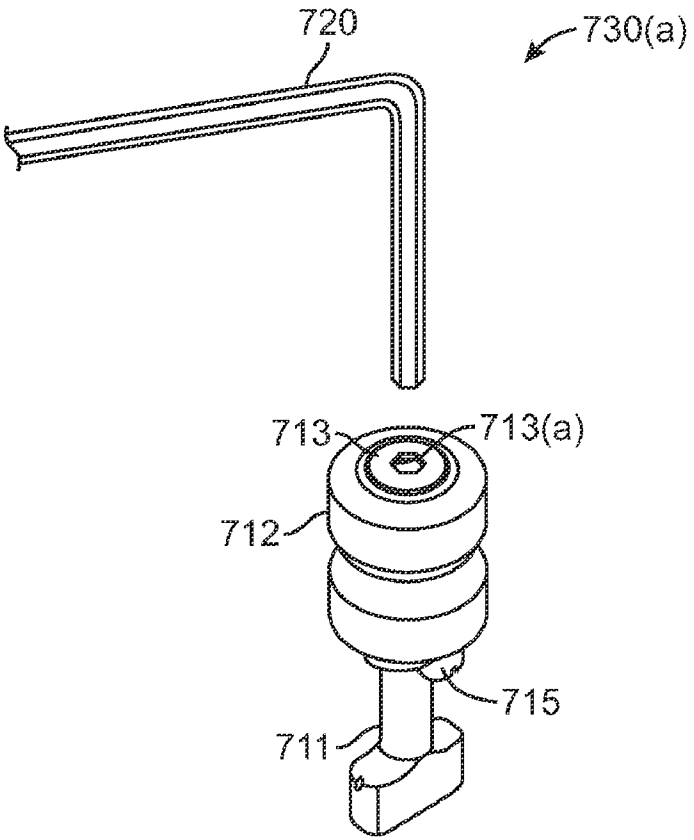
FIGS. 5G through 5H show methods of attaching attachment devices according to embodiments of the invention.
Figure 5G:
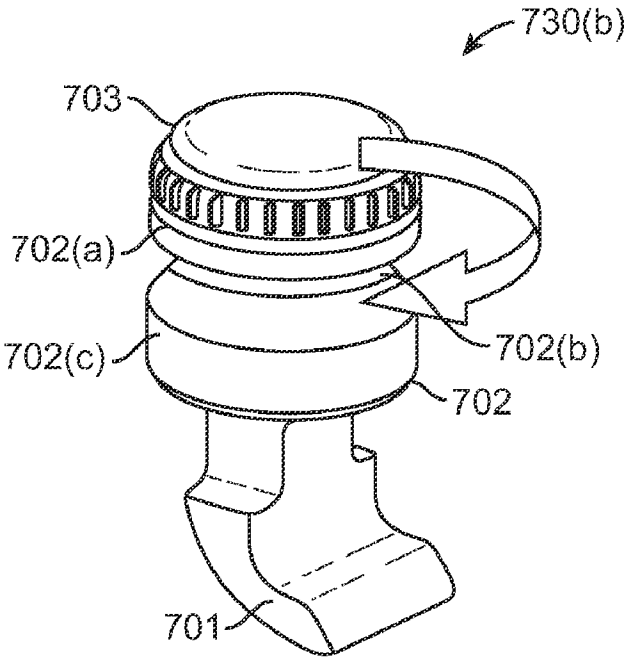

Certain embodiments of the attachment devices shown herein can be secured to (e.g., engaged with) a portable article without the need to use a screwdriver or the like. For example, FIG. 5G shows an embodiment of an attachment device 730(*b*) including an engagement member 701 having a J-hook shape. Other embodiments of the attachment device 730(*b*) may comprise other shapes, such as a T-bar. The base 702 may include a ring structure 702(*c*), a recess 702(*b*), a cap 702(*a*), and a coupling element 703 comprising a thumbscrew. The coupling element 703 may include a threaded post (e.g., a threaded rod) that extends through the base 702 and into a threaded hole (not shown) within engagement member 701. After the engagement member 701 is inserted into an aperture in a portable article, the top portion of the coupling element 703 can be turned, such as by hand. This can draw the engagement member 701 into the base 702, to clamp the attachment device 730(*b*) against the housing of the portable article.

In other embodiments of the invention, the attachment device may use a screw or other coupling element to engage with a portable article, which can be configured to receive a wrench or other external rotating structure. For example, FIG. 5H shows an embodiment of an attachment device 730(*a*) including an engagement member 711 having a T-bar shape. Other embodiments of the attachment device 703(*a*) may comprise other shapes, such as a J-hook. The base 702 may include a coupling element 713 comprising an allen screw. The coupling element 713 may include a threaded post that extends through the base 712 and into a threaded hole (not shown) within engagement member 711. After the engagement member 701 is inserted into an aperture in a portable article, the attachment device 730(*a*) may be rotated so that the stabilizing element(s) 715 are also disposed within the aperture. Then, the top portion of the coupling element 713 can be turned, such as by using an external rotating structure 720 (an allen wrench) engaged with socket 713(*a*) within the coupling element 713. This can draw the engagement member 711 into the base 712, to clamp the attachment device 730(*a*) against the housing of the portable article. The use of an external rotating structure 720, such as a wrench, can provide extra leverage for a user, allowing for the attachment device to be strongly secured to a portable article.

Figure 5K:
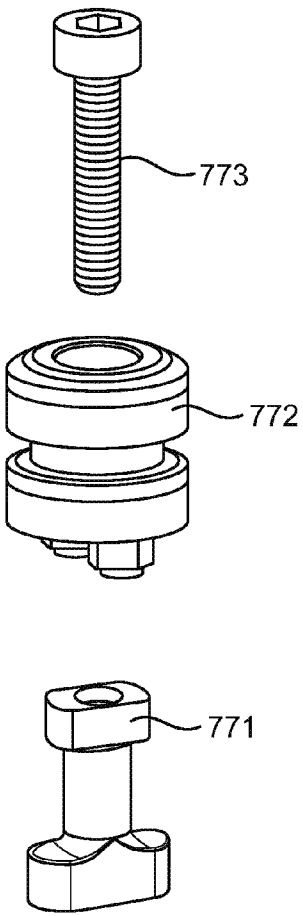
FIGS. 5I through 5K show various views of another attachment device according to an embodiment of the invention.
Figure 5J:
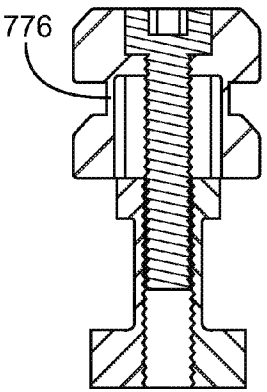
Figure 5I:
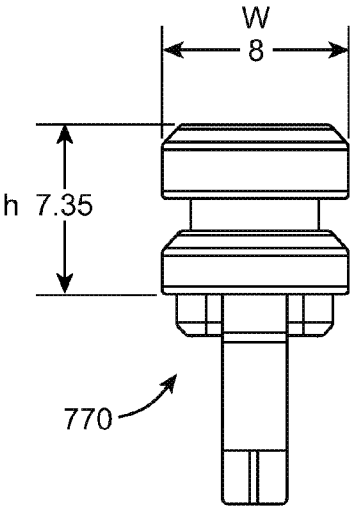

In another embodiment of the invention, the attachment device may include a recess 776 that has a substantially rectangular profile (e.g., when viewed from the side). This is shown in FIGS. 5I-5K. In FIG. 5I, the attachment device can have a maximum width W of about 8 mm. The spacing between the two ring structures (e.g., the cap and the ring structure) defining the recess can have a maximum outer distance of about 7.35 mm. As shown in FIG. 5K, the coupling element 773 can pass through an aperture in the base 772 and may couple to a T-bar 771. As described in detail below in the Examples section, the attachment device shown in FIGS. 5I-5K can have an axial pull strength of greater than about 125 lbs, such as greater than about 490 lbs, even though the dimensions of the attachment device that would extend outside of the housing of a portable electronic device would be less than about 8 mm×8 mm. Such results are surprising and unexpected.

In embodiments of the invention, the attachment device, or any of the parts thereof, as described herein (such as with respect to FIGS. 5A-5K, above) may be formed by a metal injection molding (MIM) process. This MIM process comprises mixing fine metal powders with thermoplastic binders, then kneading the mixture using a high shear rate kneader. After kneading, the homogeneous feedstock can be pelletized to facilitate loading into a molding machine. In a next step, the mixture can be injected into the molding machine, to form green parts. Next is the debinding step, where the binder material is extracted from the green parts, leaving the formed product (i.e., the attachment device or portions thereof) comprising only the metal. Then, the formed product is sintered (i.e., held at high temperature to attain the required mechanical and physical properties). Lastly, the product can be finished, such as by plating, sand blasting, drilling, tapping, heat treating, Teflon coating, phosphating, machining, etc.

The parts of the attachment device may comprise a steel comprising at least one of iron (Fe), nickel (Ni), molybdenum (Mo), and carbon (C). In exemplary embodiments, the materials used in the MIM process described above (e.g., the fine metal powders) can comprise MIM4605 metal. The "MIM4605" metal is made of approximately 0.5% carbon (C), approximately 2% nickel (Ni), approximately 0.5% molybdenum (Mo), with the balance (approximately 97%) comprising iron (Fe). Once heat treated, the MIM4605 metal can have a density greater than 7.5 g/cm$^3$, a tensile strength of 1,655 MPa, an elongation ability of 20%, and a hardness of 48 HRC (Rockwell "C" scale). In contrast, MIM4605 that is only sintered, and not further heat treated, may have a density greater than 7.5 g/cm$^3$, a tensile strength of 440 MPa, an elongation ability of 15%, and a hardness of 62 HRB (Rockwell "B" scale).

Different heat treating processes can yield different metal properties, as is known to one skilled in the art. For example, MIM4605 may be heat treated to have a hardness of 30 HRC. A hardness with a value lower than 48 HRC is desirable in some embodiments. In exemplary embodiments of the invention, it can be desirable to form the attachment device with a hardness of approximately 30 HRC. Thus, the attachment device may comprise MIM4605 metal, heat treated to a hardness of 30 HRC. In certain implementations, the attachment device may have a hardness in the range of 20 to less than 48 HRC. For example, the attachment device may be heat treated to have a hardness of approximately 25 to 35 HRC. In another example, the attachment device, or portions thereof (e.g., any or all of the engagement member, base, coupling element, etc.) may be heat treated to have a hardness of approximately 28 to 32 HRC. Once the desired hardness level is determined, various heat treating methods (including heating and subsequent cooling procedures) to create a metal with such hardness are known to those skilled in the art. Attachment devices treated to have such a hardness have been determined to provide suitable security characteristics. That is, an attachment device with a hardness of approximately 30 HRC will have good balance between ductility and brittleness. This attachment device will be both strong enough to resist pulling apart, while ductile enough to prevent shattering upon receiving forceful blows (e.g., being hit with a hammer, etc.). As such, a portable article secured with an attachment device as described herein will be exceedingly difficult to remove by force.

The various attachment devices disclosed herein have many advantages. For example, the attachment device (including the base and the engagement member) may be of a reasonable size, as compared to the previously connectors. Due to the shape and construction as described herein, the attachment device may be manufactured smaller than prior art structures, but may have equal to or greater security strength. For example, the attachment devices according to embodiments of the invention can withstand an axial pulling force of greater than about 125, 200, 300, 400, and even 500 lbs before breaking. The pull test may comprise securing the attachment device to a steel plate (or a part of the portable article to be secured, such as to a chassis or a housing of the portable article) and pulling (e.g., pulling at a 90 degree angle from the steel plate) the attachment device until it breaks. That is, the attachment device may be constructed so it does not protrude far (or at all) from the edge of the housing of the portable article while being attached. The attachment devices shown herein are very user friendly. Still, the attachment device as disclosed herein can be secured to the portable article with sufficient strength so that it cannot be easily pulled, twisted, or otherwise removed.

The operation of security apparatuses disclosed herein can be described with reference to FIGS. 6A-7B. In embodiments of the invention, a method for using the security apparatus may comprise: obtaining a portable article, and an attachment device attached to the portable article; and attaching a head to the attachment device, wherein the head comprises (i) a housing, (ii) a gate structure (or other suitable securing element) within the housing and configured to engage the base of the attachment device, (iii) a biasing element configured to bias the gate structure toward the base, and (iv) a locking component inside of the housing. The locking component can be in a locked configuration after the base is attached to the attachment device (without requiring a key).

Figure 6A:
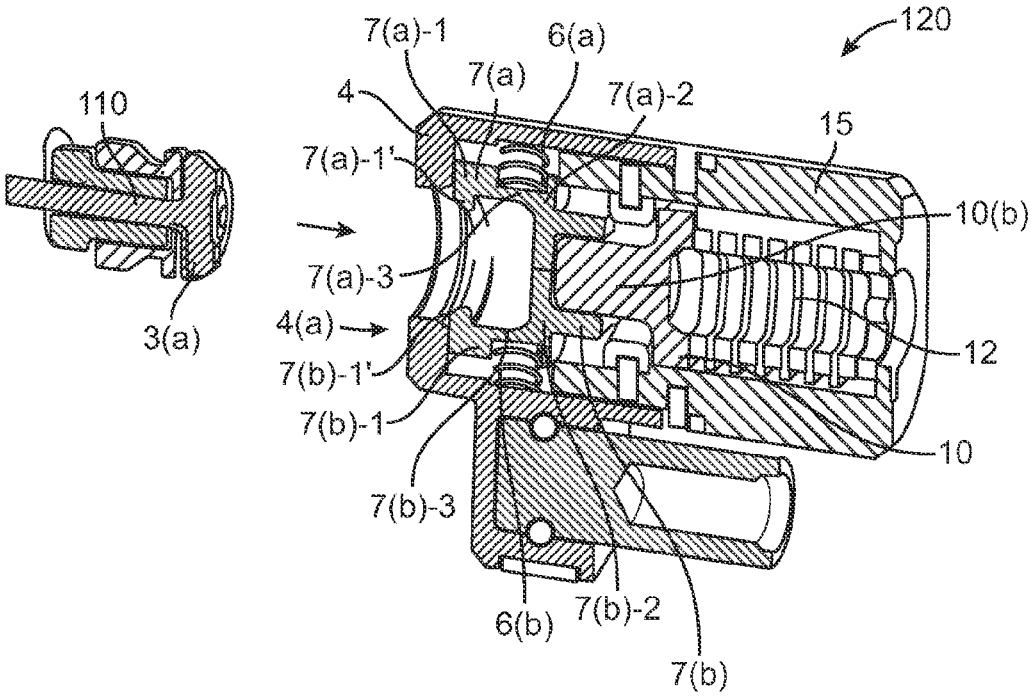
FIG. 6A shows a side, cross-sectional view of a security apparatus, before the head engages the attachment device.

Referring to FIG. 6A, the attachment device 110 can be first secured to a portable article as described above. The head 120 can be positioned toward the security device 110 such that the hole 4(*a*) in the first housing portion 4 of the head 120 is aligned with the cap 3(*a*). In FIG. 6A, the springs 6(*a*), 6(*b*) bias the first and second gate structures 7(*a*), 7(*b*) inward in the absence of outward pressure. Each gate structure 7(*a*), 7(*b*) may have a front wall portion 7(*a*)-1, 7(*b*)-1, a rear wall portion 7(*a*)-2, 7(*b*)-2 and a bridging portion 7(*a*)-3, 7(*b*)-3. These portions may define a recess which can house a corresponding spring 6(*a*), 6(*b*).

Figure 6B:
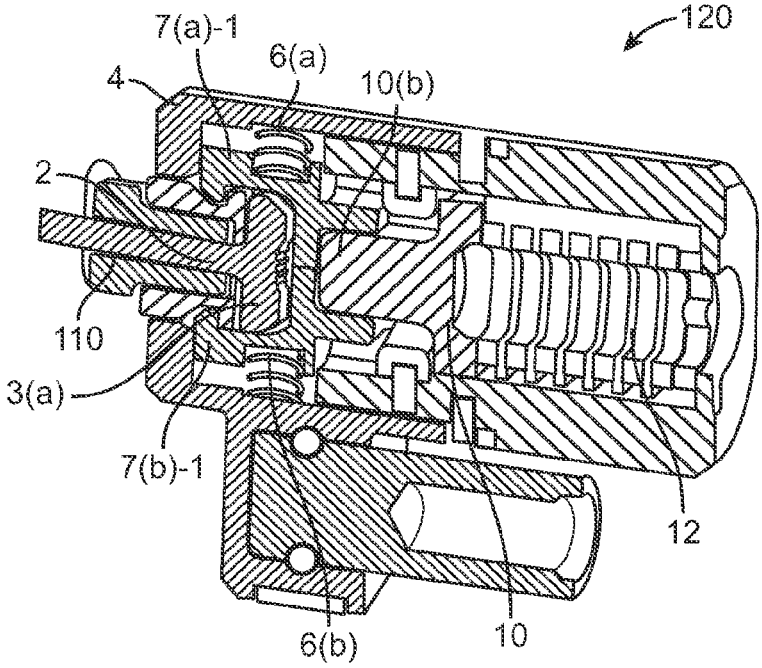
FIG. 6B shows a side, cross-sectional view of a security apparatus in a locked configuration.

Referring to both FIGS. 6A and 6B, each front wall portion 7(*a*)-1, 7(*b*)-1 may have an inward sloped surface 7(*a*)-1', 7(*b*)-1', which allows the cap 3(*a*) (e.g., the forward portion of the base) to push the gate structures 7(*a*), 7(*b*) radially outward as the cap 3(*a*) passes axially into the hole 4(*a*), thereby compressing the springs 6(*a*), 6(*b*). Once the cap 3(*a*) passes the front wall portions 7(*a*)-1, 7(*b*)-1, the gate structures 7(*a*), 7(*b*) clamp down on it, and it cannot be withdrawn from the head 120. While in the locked configuration, the springs 6(*a*), 6(*b*) bias the first and second gate structures 7(*a*), 7(*b*) towards the base, so that the front wall portions 7(*a*)-1, 7(*b*)-1 of the gate structures 7(*a*), 7(*b*) prevent withdrawal of the attachment device 110 from the locking head 120. The locking component in the head 120 in FIGS. 6A and 6B is in a locked configuration, and the head 120 cannot be separated from the security device 110 unless an authorized key is used.

Figure 7B:
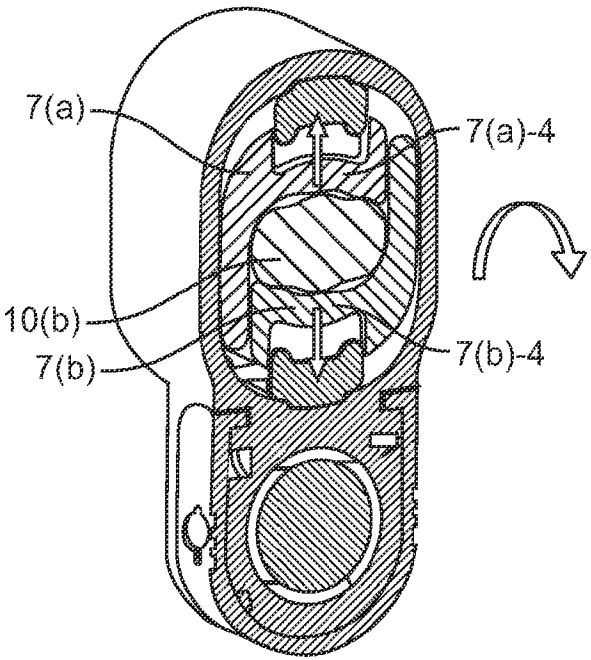
FIG. 7B shows a front cross-sectional view of a head.
Figure 7A:
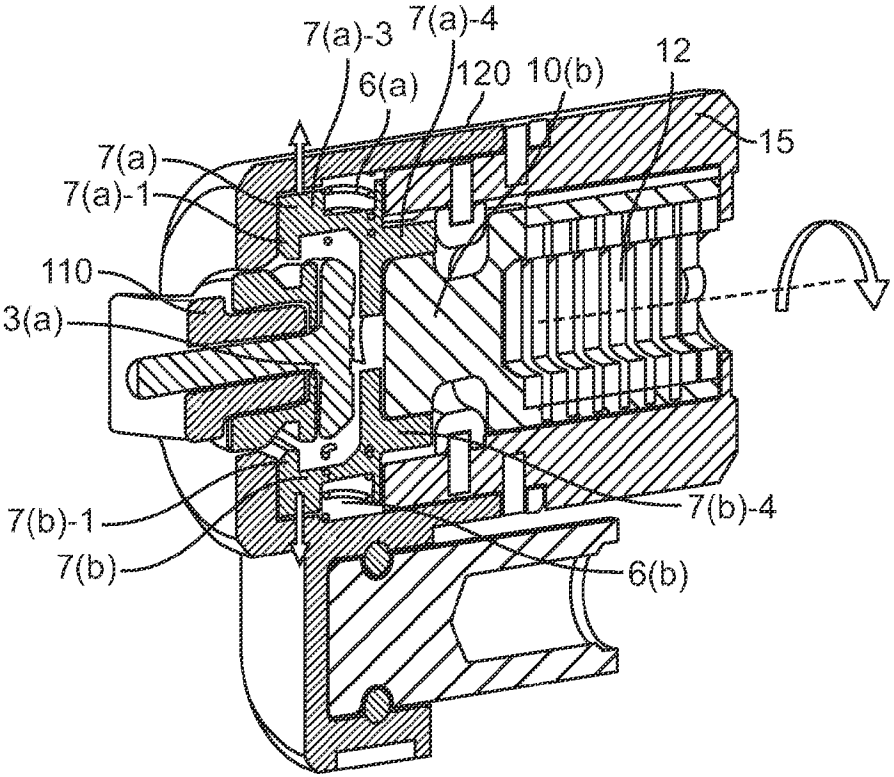
FIG. 7A shows a side, cross-sectional view of a security apparatus in an unlocked configuration.

FIGS. 7A-7B show how the head 120 can be separated from the attachment device 110. As shown in FIGS. 7A and 7B, an authorized key (not shown) is inserted into the head 120 to unlock the locking component 12 in the head 120. The key can thus turn the actuator 10(*b*) (e.g., clockwise in FIG. 7B) such that protrusions 7(*a*)-4, 7(*b*)-4 in the first and second gate structures 7(*a*), 7(*b*) are engaged and are pushed outward. This forces the gate structures 7(*a*), 7(*b*) outward and compresses the springs 6(*a*), 6(*b*). The front wall portions 7(*a*)-1, 7(*b*)-1 of the first and second gate structures 7(*a*), 7(*b*) no longer obstruct the cap 3(*a*) from being separated from the head 120. This allows the locking head 120 to be removed from the attachment device 110, such as to allow for transport of the previously secured portable article. FIG. 7B shows the first and second gate structures 7(*a*), 7(*b*) may each have an "L" shape, and may overlap with portions of each other along the sides of the device. This can allow for reliable operation.

Embodiments of the locking heads as disclosed herein provide for improved methods of locking and unlocking. For example, in certain embodiments, no key may be necessary to lock the head against the attachment device. The locking head may be capable of securing to the attachment device upon a single movement of the locking head, using the securing element. Thus, the head may be secured to the attachment device such that the locking head (e.g., the locking component) is in a locked configuration (i.e., a secured configuration, while secured to the attachment device) without the use of a key; rather, only a single motion (e.g. a single linear motion, a single rotational motion, etc.), such as sliding the attachment device toward the base may be used. Therefore, the locking head may be in a locked configuration upon a single movement of the locking head. The head may indicate it is then in the locked configuration by producing a sound, such as a "click." The locking heads disclosed herein are therefore quite user friendly. Less effort is required to secure a portable article, and a user may be assured that the locking head is properly in place.

Figure 8:
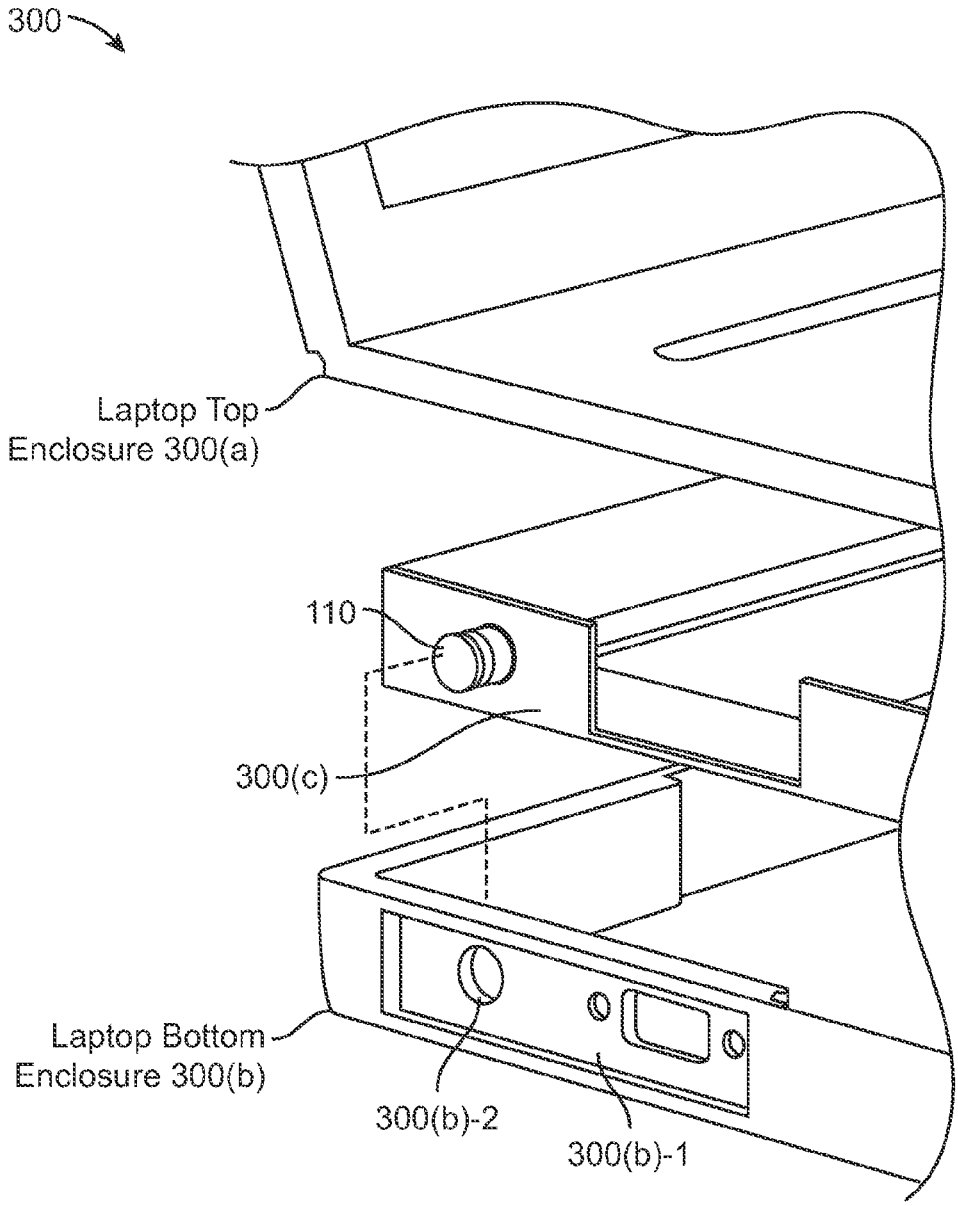
FIGS. 8-10 show exploded, perspective views of portable electronic devices with attachment devices attached thereto.
Figure 9B:
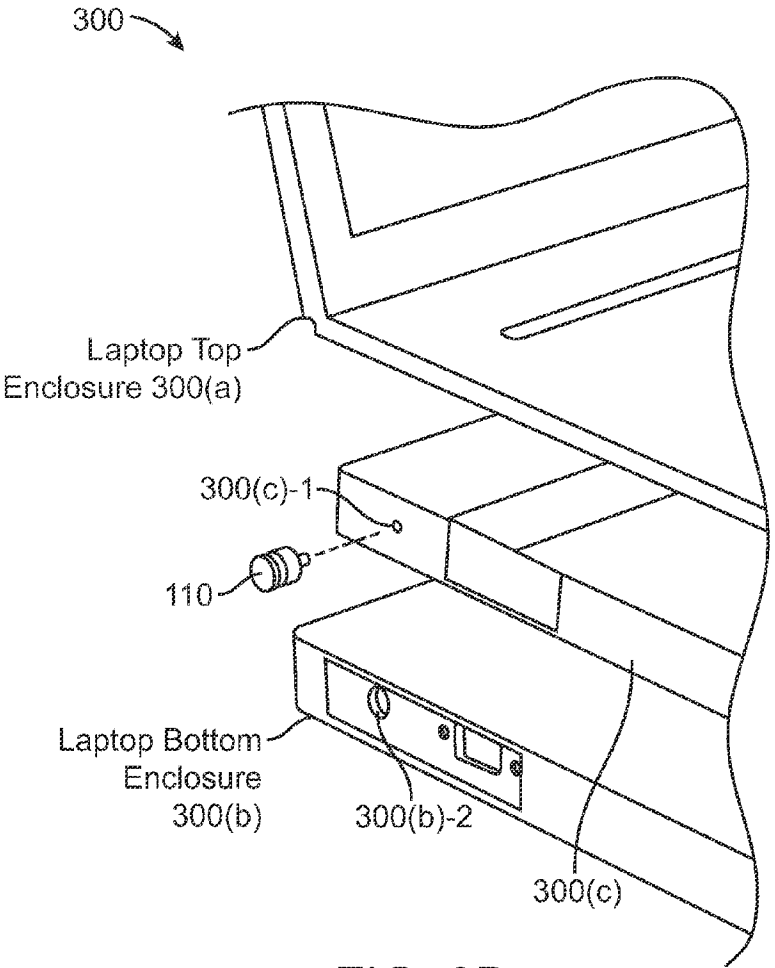
Figure 9A:
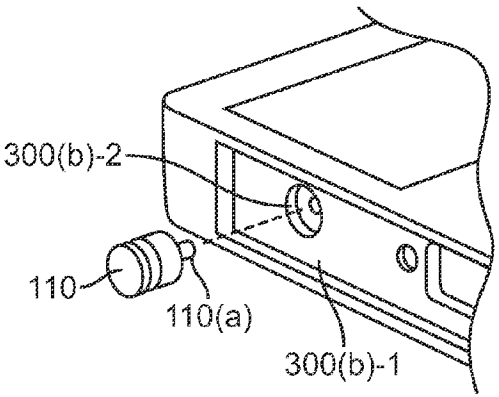
Figure 9C:
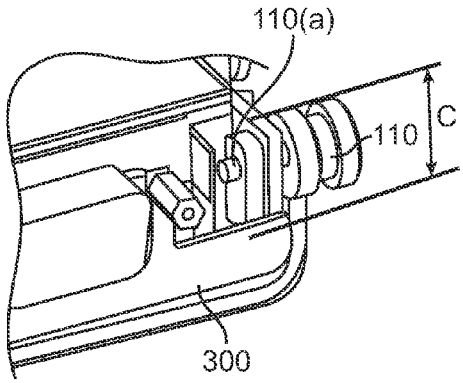
Figure 9D:
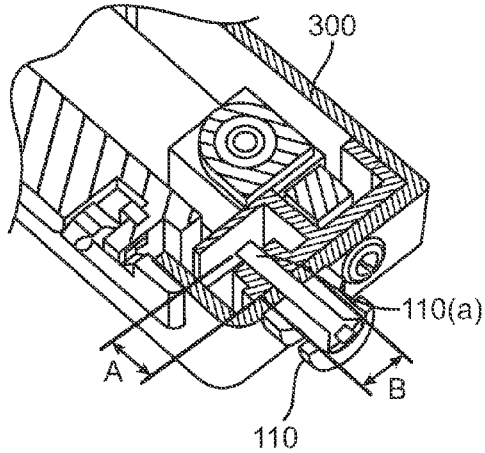
Figure 9E:
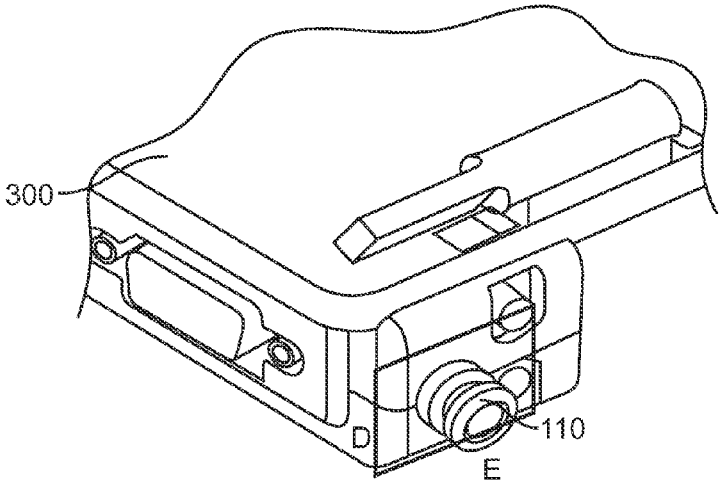
Figure 10:
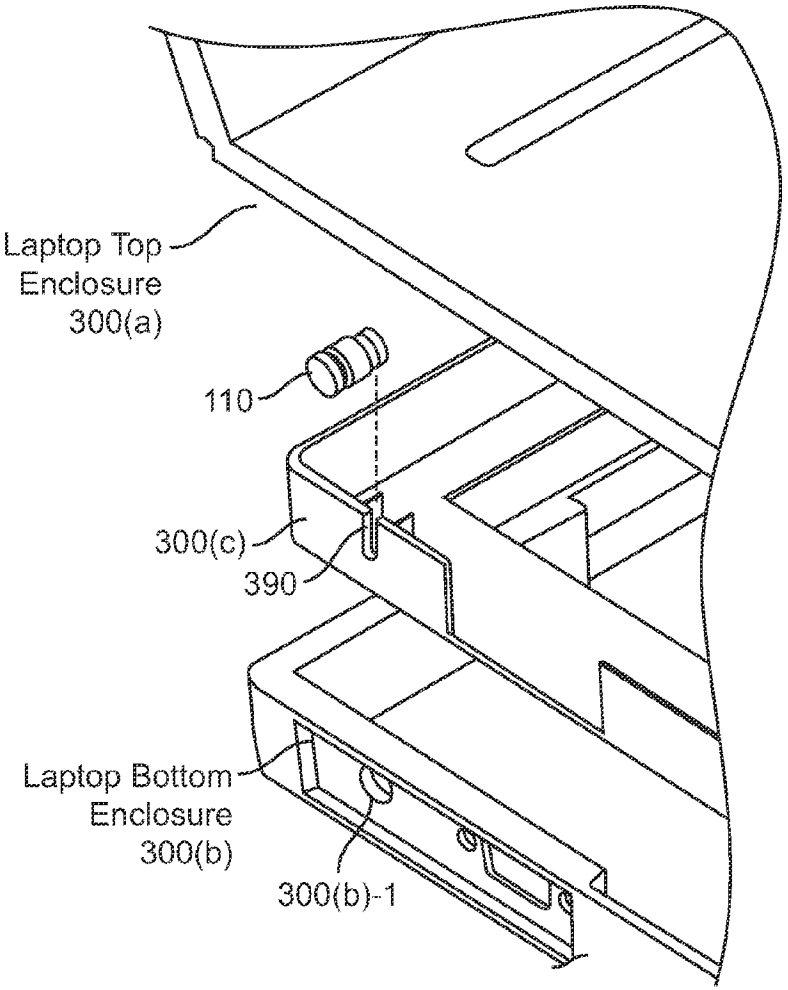
Figure 10:
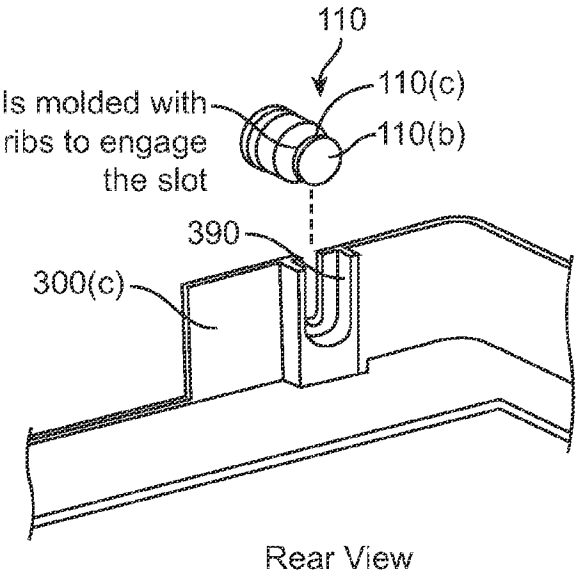

FIGS. 8-10 show various ways in which an attachment device can be secured to a portable article.

In FIG. 8, the portable article 300 may include a housing having a top enclosure 300(*a*) and a bottom enclosure 300(*b*), and also an internal chassis 300(*c*) within the housing 300(*a*), 300(*b*). The bottom enclosure 300(*b*) may include a cavity 300(*b*)-1, and a hole 300(*b*)-2 within the cavity 300(*b*)-1. The hole 300(*b*)-2 may expose a portion of the chassis 300(*c*). As shown in FIG. 8, the attachment device 110 may be molded and/or integral with the internal (metal) chassis 300(*c*), and may pass through the second hole 300(*b*)-2 in the bottom enclosure 300(*b*). The attachment device 110 DOOM the hole 300(*b*)-2, and the cavity 300(*b*)-1 may be configured so that the attachment device 110 does not extend past the edge of the housing. In other embodiments, the attachment device 110 may only slightly extend past the edge of the housing, such as by at most about 3 mm. This can prevent the attachment device 110 from being awkwardly placed or otherwise provide an undesirable protrusion from the portable article.

The embodiment in FIGS. 9A and 9B is similar to FIG. 8, except that the attachment device 110 has an engagement member comprising a threaded post 110(*a*), which is secured to a hole 300(*c*)-1 (e.g. a threaded hole) in the internal chassis 300(*c*). As in FIG. 8, the attachment device 110 may pass through a hole 300(*b*)-2 in the bottom enclosure 300(*b*). The holes 300(*b*)-2 and 300(*c*)-1 may each comprise a threaded or non-threaded hole. Furthermore, the hole 300(*b*)-2 may be aligned with the hole 300(*c*)-1 in the chassis 300(*c*), and may expose a portion of the chassis 300(*c*). The attachment device 110 may be threadably engaged with the threaded hole 300(*c*)-1, in order to be attached to the portable article. In certain embodiments, the threaded post 110(*a*) attached to the base of the attachment device 110 can also be threadably engaged with a threaded hole 300(*b*)-2 in the housing of the portable article 300. The cavity 300(*b*)-1 may surround the hole 300(*b*)-2, and both the cavity 300(*b*)-1 and the hole 300(*b*)-2 may be formed (such as by molding or other suitable process) in the housing. In certain embodiments, the outside end of the attachment device may comprise a tapered end having a smooth surface, to prevent the device from snagging or otherwise troubling a user.

In certain embodiments, the hole 300(*b*)-2 may not be threaded, and may have a diameter equal to or greater than the diameter of the base of the attachment device 110. The attachment device may reside within the hole 300(*b*)-2 and also within the cavity 300(*b*)-1 while being attached to the chassis 300(*c*). This can allow the attachment device to be securely attached to the portable article, without extending past (or much past, e.g. at most 3 mm) the edge of the housing of the portable article. In exemplary embodiments, the attachment device can comprise a single screw (e.g., only one screw) that attaches to the chassis 300(*c*). In certain embodiments, the attachment device can directly contact the chassis, as the threaded post 110(*a*) can threadably engage directly with the hole 300(*c*)-1, for greater security.

Because part of the attachment device 110, and in particular, the ring structure, is both cooperatively structured with and within the hole 300(*b*)-2, the attachment device 110 is secured in such a way that the lateral movement of the attachment device 110 relative to the housing is difficult, thus enhancing the security of the apparatus. Further, as noted above, the attachment device 110 does not protrude outwardly from the housing very far, thus making the use of the attachment device 110 palatable to both consumers and manufacturers.

FIGS. 9C-9E show internal and external displacements of an attachment device 110 that is attached to a housing of a portable article 300, according to an embodiment of the invention. FIG. 9C shows a view of the outside back portion of a portable article 300, FIG. 9D shows a side section view of the portable article 300, and FIG. 9E shows a view of the side portion of a portable article 300. As can be seen in FIGS. 9C-9E, the internal displacement of the attachment device 110, specifically the threaded post 110(*a*), as shown by the A×B×C marked lengths, can comprise about 4 mm×4.5 mm×4.5 mm. Furthermore, the outside area of the portable article 300 that could be used for the attachment device 110, as shown by the D×E marked lengths, can comprise 13 mm×22 mm, based on the centered axis of the hole 300(*c*)-1. Embodiments described herein can thus provide enhanced security while using a reduced footprint. As portable articles, such as a computers, continue to get smaller, space becomes more precious. Embodiments disclosed herein can advantageously provide security without impinging on other features of the secured portable articles, and are small enough to work well with products not yet produced, even as such products shrink.

In the embodiment in FIG. 10, the chassis 300(*c*) of the portable article can be built with a drop in slot 390, which is configured to receive an attachment device 110 with a body 110(*b*) and a groove 110(*c*). The body 110(*b*) can fit within the slot 390, such that the top enclosure 300(*a*) will prevent the attachment device 110 from being removed from the slot 390.

Embodiments of the invention have a number of advantages. The attachment device according to embodiments of the invention can be attached to an aperture in a portable article, or it may be attached to another part of the portable article. Further, the head including the locking component can be attached to the attachment device with a single motion, thus making it easier for a user to use. Also, because the attachment device can be small, it can be used with most commercially available thin portable articles such as laptop computers.

Further, embodiments of the invention advantageously provide for greater strength than other conventional locking systems, while being smaller in size.

EXAMPLES

Example 1

Embodiments of the invention were tested for strength. The axial pull strength of an attachment device of the type shown in FIG. 5G attached to a substantially rectangular slot in a steel plate about 4 mm thick was evaluated. Thirty samples were subjected to an axial pulling force. The thumbscrew had an M2 screw, a zinc die case spur body, and a J-hook made of an MIM (metal injection molding) material. The average tensile force required to break the attachment device was 125 lbs.

Example 2

The axial pull strength of an attachment device of the type shown in FIG. 5D attached to a substantially rectangular slot in a steel plate about 4 mm thick was evaluated. Ten samples were subjected to an axial pulling force in a static load test. The attachment device had an M2 screw comprising 18-8 Stainless Steel, a zinc die case spur base, and a J-hook made of an MIM (metal injection molding) material (MIM4605). The MIM4605 material was sintered but not further heat treated. The M2 screw comprised an M2×0.4 mm Socket Head Cap Screw. The average tensile force required to break the attachment device was about 280 lbs.

TABLE 1

| Sample | Test Result (lbs) |
|---|---|
| 1 | 136.4 |
| 2 | 171.6 |
| 3 | 382.8 |
| 4 | 308.0 |
| 5 | 267.3 |
| 6 | 299.2 |
| 7 | 303.8 |
| 8 | 336.6 |
| 9 | 348.0 |
| 10 | 338.1 |
| Average | 289.4 |

Compared to the embodiment in FIG. 5G and in Example 1 above, to achieve higher clamping forces, the thumbscrew was replaced with an M2×0.4 mm socket head cap screw. The attachment device can use an Allen key to tighten the screw. More torque force can be applied through the key.

Example 3

The axial pull strength of an attachment device of the type shown in FIG. 5E attached to a substantially rectangular slot in a steel plate about 4 mm thick was evaluated. Five samples were subjected to an axial pulling force from a static load test. The attachment device had an M2 screw comprising a high strength 12.9 class screw, an MIM4605 spur body, and a T-bar (comprising MIM4605). The average tensile force required to break the attachment device was about 410 lbs.

TABLE 1

| Sample | Test Result (lbs) |
|---|---|
| 1 | 372.0 |
| 2 | 447.0 |
| 3 | 399.3 |
| 4 | 370.4 |
| 5 | 472.9 |
| Average | 412.3 |

Compared to the embodiment in FIG. 5G and in Example 1 above, the slot attachment J-hook was replaced with a T-bar made of M4605 metal as described herein. The T-bar metal was not further heat treated beyond sintering.

Example 4

The axial pull strength of an attachment device of the type shown in FIGS. 5I, J, and K attached to a substantially rectangular slot in a steel plate about 4 mm thick was evaluated. Eight samples were subjected to an axial pulling force at a pull speed in a static load test. The attachment device had an M2 screw comprising a high strength 12.9 class screw that has been heat treated and tempered, an MIM4605 base, and a T-bar (MIM4605, hardened to 30 Rockwell C). The average tensile force required to break the attachment device was 490 lbs.

TABLE 3

| Sample | Test Result (lbs) |
|---|---|
| 1 | 440.0 |
| 2 | 534.3 |
| 3 | 460.8 |
| 4 | 491.8 |
| 5 | 551.2 |
| 6 | 515.5 |
| 7 | 506.2 |
| 8 | 471.9 |
| Average | 496.5 |

Compared to the embodiment in FIG. 5E and in Example 3 above, the screw had modified heat treating and tempering, and the T-Bar material was hardened, to achieve higher tensile strength. Furthermore, the recess profile was modified to have a substantially rectangular profile as described above, which further improved the tensile strength.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

One or more features from any embodiment may be combined with one or more features of any other embodiment without departing from the scope of the invention. Where approximate or "about" is described for measurements, embodiments herein also contemplate the exact measurement. Where a shape is disclosed, such as a cylinder, embodiments herein contemplate other suitable shapes, such as multi-sided blocks (octagonal structures, decagonal structures, etc.), other rectangular structures, etc. In certain implementations, structures with multiple sides approaching the shape of cylinders, as well as substantially cylindrical shapes (e.g., a cylinder with a flat sidewall portion) may be considered cylinders as described herein, unless otherwise specified.

A recitation of "a", "an" or "the" is intended to mean "one or more" unless specifically indicated to the contrary.

What is claimed is:

1. A security apparatus for a portable electronic device secured to an attachment device having a base, the security apparatus comprising:

a head comprising a housing, a gate structure within the housing, the gate structure including a front wall portion having an inward sloped surface, a rear wall portion, a bridging portion connected to the front wall portion and the rear wall portion, and a rear protrusion extending from the rear wall portion, a biasing element configured to bias the gate structure inwardly toward the base, a locking component inside of the housing, and an actuator configured to engage the rear protrusion when the locking component is in an unlocked configuration, the actuator extending from the locking component wherein the gate structure is a first gate structure and the biasing element is a first biasing element, and wherein the security apparatus further comprises a second gate structure and a second biasing element, the first and second gate structures being non-pivotally mounted within the head, wherein the first and second biasing elements are configured to bias the first and second gate structures toward the base and towards each other when the locking component is in a locked configuration; and a security device physically coupled to the head, wherein the security device is adapted to be secured to an immovable object.

2. The security apparatus of claim 1 wherein portions of the first gate structure overlap with portions of the second gate structure.

3. The security apparatus of claim 1 wherein the actuator is configured to move the first gate structure away from the base by engaging the rear protrusion.

4. The security apparatus of claim 3 wherein the actuator is configured to move the first gate structure by turning.

5. The security apparatus of claim 1 wherein the actuator is a cam.

6. The security apparatus of claim 1 wherein the security device is a cable.

7. The security apparatus of claim 6 wherein the immovable object is a desk.

8. A system comprising:

a portable electronic device; and a security apparatus comprising an attachment device secured to the portable electronic device, the attachment device comprising a base, and a head comprising a housing, a gate structure within the housing, the gate structure including a front wall portion having an inward sloped surface, a rear wall portion, a bridging portion connected to the front wall portion and the rear wall portion, and a rear protrusion extending from the rear wall portion, a biasing element configured to bias the gate structure inwardly toward the base, a locking component inside of the housing, and an actuator configured to engage the rear protrusion when the locking component is in an unlocked configuration, the actuator extending from the locking component, wherein the gate structure is a first gate structure and the biasing element is a first biasing element, and wherein the security apparatus further comprises a second gate structure and a second biasing element, the first and second gate structures being non-pivotally mounted within the head, wherein the first and second biasing elements are configured to bias the first and second gate structures toward the base and towards each other when the locking component is in a locked configuration, and a security device physically coupled to the head, wherein the security device is adapted to be secured to an immovable object.

9. The system of claim 8, wherein the portable electronic device comprises a computer.

10. The system of claim 8, wherein the head further comprises a multi jointed ferrule that is configured to connect to a security device, the multi jointed ferrule comprising a first ferrule and a swivel ferrule, wherein the first ferrule is rotatably connected to a swivel adapter of the swivel ferrule.

11. The system of claim 8, wherein portions of the first gate structure overlap with portions of the second gate structure.

12. The system of claim 8, wherein the head is configured to be locked by a single linear motion comprising moving the head towards the attachment device.

13. The system of claim 12, wherein the gate structure is configured to clamp down upon the attachment device while locked, and the head is configured to produce a sound to indicate that it has been locked.

14. A method of securing a portable electronic device, the method comprising:

obtaining a portable electronic device, and an attachment device attached to the portable electronic device, wherein the attachment device comprises a base extending from the portable electronic device; and attaching a head to the attachment device, wherein the head comprises a housing, a gate structure within the housing, the gate structure including a front wall portion having an inward sloped surface, a rear wall portion, a bridging portion connected to the front wall portion and the rear wall portion, and a rear protrusion extending from the rear wall portion, a biasing element configured to bias the gate structure toward the base, a locking component inside of the housing, and an actuator configured to engage the rear protrusion when the locking component is in an unlocked configuration, the actuator extending from the locking component, wherein the locking component is in a locked configuration after the head is attached, wherein the gate structure is a first gate structure and the biasing element is a first biasing element, and wherein the security apparatus further comprises a second gate structure and a second biasing element, the first and second gate structures being non-pivotally mounted within the head, wherein the first and second biasing elements are configured to bias the first and second gate structures toward the base and towards each other when the locking component is in a locked configuration, and wherein a security device is physically coupled to the head, wherein the security device is adapted to be secured to an immovable object.

15. The method of claim 14, wherein the attaching the head comprises moving the head in a single linear motion towards the attachment device.

16. The method of claim 15, wherein the base pushes the gate structure outward until the base passes the front wall portion, during the single linear motion.

17. The method of claim 14, wherein a key is not necessary to attach the head to the attachment device.

18. The method of claim 17, further comprising:

inserting a key into the head;

turning the actuator to engage the rear protrusion, wherein the actuator pushes the rear protrusion outward and compresses the first biasing element; and removing the head from the attachment device.

19. The method of claim 14, wherein the head indicates it is in the locked configuration by producing a sound.

* * * * *